US010564596B2

(12) United States Patent
Itabashi et al.

(10) Patent No.: US 10,564,596 B2
(45) Date of Patent: Feb. 18, 2020

(54) IMAGE FORMING APPARATUS HAVING A DRAWER INCLUDING AN EXPOSURE HEAD

(71) Applicant: BROTHER KOGYO KABUSHIKI KAISHA, Nagoya-shi, Aichi-ken (JP)

(72) Inventors: Nao Itabashi, Nagoya (JP); Masamitsu Ukai, Nagoya (JP); Masato Makino, Kariya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/183,898

(22) Filed: Nov. 8, 2018

(65) Prior Publication Data

US 2019/0146405 A1 May 16, 2019

(30) Foreign Application Priority Data

Nov. 10, 2017 (JP) ..... 2017-216932

(51) Int. Cl.
*G03G 21/00* (2006.01)
*G03G 21/16* (2006.01)
*G03G 21/18* (2006.01)

(52) U.S. Cl.
CPC ..... *G03G 21/1676* (2013.01); *G03G 21/1671* (2013.01); *G03G 21/1821* (2013.01); *G03G 21/1842* (2013.01); *G03G 21/1853* (2013.01); *G03G 2221/163* (2013.01); *G03G 2221/1606* (2013.01); *G03G 2221/1869* (2013.01)

(58) Field of Classification Search
CPC ..... G03G 21/1647; G03G 21/1671; G03G 21/1676; G03G 21/1821; G03G 21/1842; G03G 21/1846; G03G 21/1853; G03G 2221/163; G03G 2221/1606; G03G 2221/1654; G03G 2221/1846; G03G 2221/1869
USPC ..... 399/111, 113
See application file for complete search history.

(56) References Cited

U.S. PATENT DOCUMENTS 8,290,395 B2 * 10/2012 Uchida ..... G03G 21/1839 399/110
8,737,870 B2 * 5/2014 Mori ..... G03G 21/1853 399/110
9,058,015 B2 * 6/2015 Sato ..... G03G 21/1633
9,134,690 B2 * 9/2015 Kato ..... G03G 21/1832
(Continued)

FOREIGN PATENT DOCUMENTS

JP 2012-144019 A 8/2012
JP 2013210651 A * 10/2013
JP 2016-4113 A 1/2016

*Primary Examiner* — Robert B Beatty
(74) *Attorney, Agent, or Firm* — Merchant & Gould P.C.

(57) ABSTRACT

An image forming apparatus includes a drawer having an exposure head. The drawer can include first and second guides to receive a drum cartridge and a developer cartridge, respectively. The first guide extends from a first side of the drawer into the drawer and toward the exposure head from a first side of the exposure head, and the second guide extends from the first side of the drawer into the drawer and toward the exposure head from a second side of the exposure head opposite the first side. In some instances, the drum cartridge is positioned at least partially below the developer cartridge but is removable from the drawer without removing the developer cartridge.

24 Claims, 24 Drawing Sheets

(56) References Cited

U.S. PATENT DOCUMENTS

| | | | | |
|---|---|---|---|---|
| 9,429,900 | B2 * | 8/2016 | Suzuki | G03G 21/1633 |
| 2012/0183320 | A1 | 7/2012 | Sato et al. | |
| 2012/0237256 | A1 * | 9/2012 | Souda | G03G 21/1647 399/119 |
| 2015/0362888 | A1 * | 12/2015 | Itabashi | G03G 21/1647 399/111 |
| 2017/0060081 | A1 * | 3/2017 | Kikuchi | G03G 21/1647 |
| 2017/0176925 | A1 * | 6/2017 | Sakakibara | G03G 21/1609 |

* cited by examiner

IMAGE FORMING APPARATUS HAVING A DRAWER INCLUDING AN EXPOSURE HEAD

CROSS-REFERENCE TO RELATED APPLICATION

This application claims priority from Japanese Patent Application No. 2017-216932 filed on Nov. 10, 2017, the content of which is incorporated herein by reference in its entirety.

TECHNICAL FIELD

Aspects disclosed herein relate to an image forming apparatus.

BACKGROUND

A known image forming apparatus includes drum cartridges, developer cartridges, and a drawer. Each of the drum cartridges includes a photosensitive drum. Each of the developer cartridges stores toner to be supplied to a circumferential surface of a corresponding one of the photosensitive drums. The drawer includes exposure heads, each of which is configured to expose the circumferential surface of a corresponding one of the photosensitive drums.

SUMMARY

When a user attaches or detaches a drum cartridge or a developer cartridge to or from such a drawer including the exposure heads, the user may need to avoid contact of the drum cartridge or the developer cartridge to a corresponding exposure head.

Accordingly, some embodiments of the disclosure provide for an image forming apparatus that may enable a drum cartridge and a developer cartridge to be attached to or detached from a drawer including an exposure head without being contacted to the exposure head.

In order to attain the above and other objects, the disclosure provides for an image forming apparatus. The image forming apparatus includes a housing and a drawer. The drawer is movable in a drawer moving direction between an inside position in which the drawer is positioned within the housing and an outside position in which the drawer is positioned outside the housing. The drawer includes an exposure head mounted within the drawer, as well as a first guide and a second guide. The first guide is positioned to receive a drum cartridge into a drum cartridge operating position in which a circumferential surface of a photosensitive drum included in the drum cartridge is adjacent to the exposure head. The second guide is positioned to receive a developer cartridge into a developer cartridge operating position in which a developing roller of the developer cartridge contacts the photosensitive drum. The first guide extends from a first side of the drawer into the drawer and toward the exposure head from a first side of the exposure head, and the second guide extends from the first side of the drawer into the drawer and toward the exposure head from a second side of the exposure head opposite the first side.

In a further aspect, the disclosure provides for an image forming apparatus including a housing and a drawer. The drawer is movable in a drawer moving direction between an inside position in which the drawer is positioned within the housing and an outside position in which the drawer is positioned outside the housing. The drawer includes an exposure head mounted within the drawer. The image forming apparatus further includes a drum cartridge inserted into a drum cartridge operating position in which a circumferential surface of a photosensitive drum included in the drum cartridge is adjacent to the exposure head, and a developer cartridge inserted into a developer cartridge operating position in which a developing roller of the developer cartridge contacts the photosensitive drum. In the drum cartridge operating position, the drum cartridge is positioned at least partially below the developer cartridge but is removable from the drawer without removing the developer cartridge.

In a still further aspect, the present disclosure provides for a image forming apparatus that comprises a housing, a first drum cartridge, a second drum cartridge, a first developer cartridge, and a drawer. The first drum cartridge comprises a first photosensitive drum. The second drum cartridge comprises a second photosensitive drum. The first developer cartridge is configured to store toner to be supplied onto a circumferential surface of the first photosensitive drum. The drawer is configured to move between an inside position and an outside position in a drawer moving direction. The drawer is within the housing when the drawer is located at the inside position. The drawer is out of the housing when the drawer is located at the outside position.

The drawer comprises a first exposure head, a second exposure head, a drum cartridge guide and a developer cartridge guide. The first exposure head is configured to expose the circumferential surface of the first photosensitive drum. The second exposure head is configured to expose the circumferential surface of the second photosensitive drum. The drum cartridge guide is configured to guide the first drum cartridge during attachment of the first drum cartridge to the drawer. The developer cartridge guide further comprises a first guide portion, a second guide portion and a third guide portion. The first guide portion is configured to guide the second drum cartridge during the attachment of the second drum cartridge to the drawer and guide the first developer cartridge during the attachement of the first developer cartridge to the drawer. The second guide portion is configured to guide the developer cartridge subsequent to the first guide portion during the attachment of the the first developer cartridege to the drawer. The third guide portion is configured to guide the second drum cartridge subsequent to the first guide portion during the attachment of the second drum cartridge to the drawer.

According to the one or more aspects of the disclosure, the drum cartridge and the developer cartridge may be enabled to be attached to or detached from the drawer including the exposure head without contacting the exposure head.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

1. Image Forming Apparatus

Figure 1:
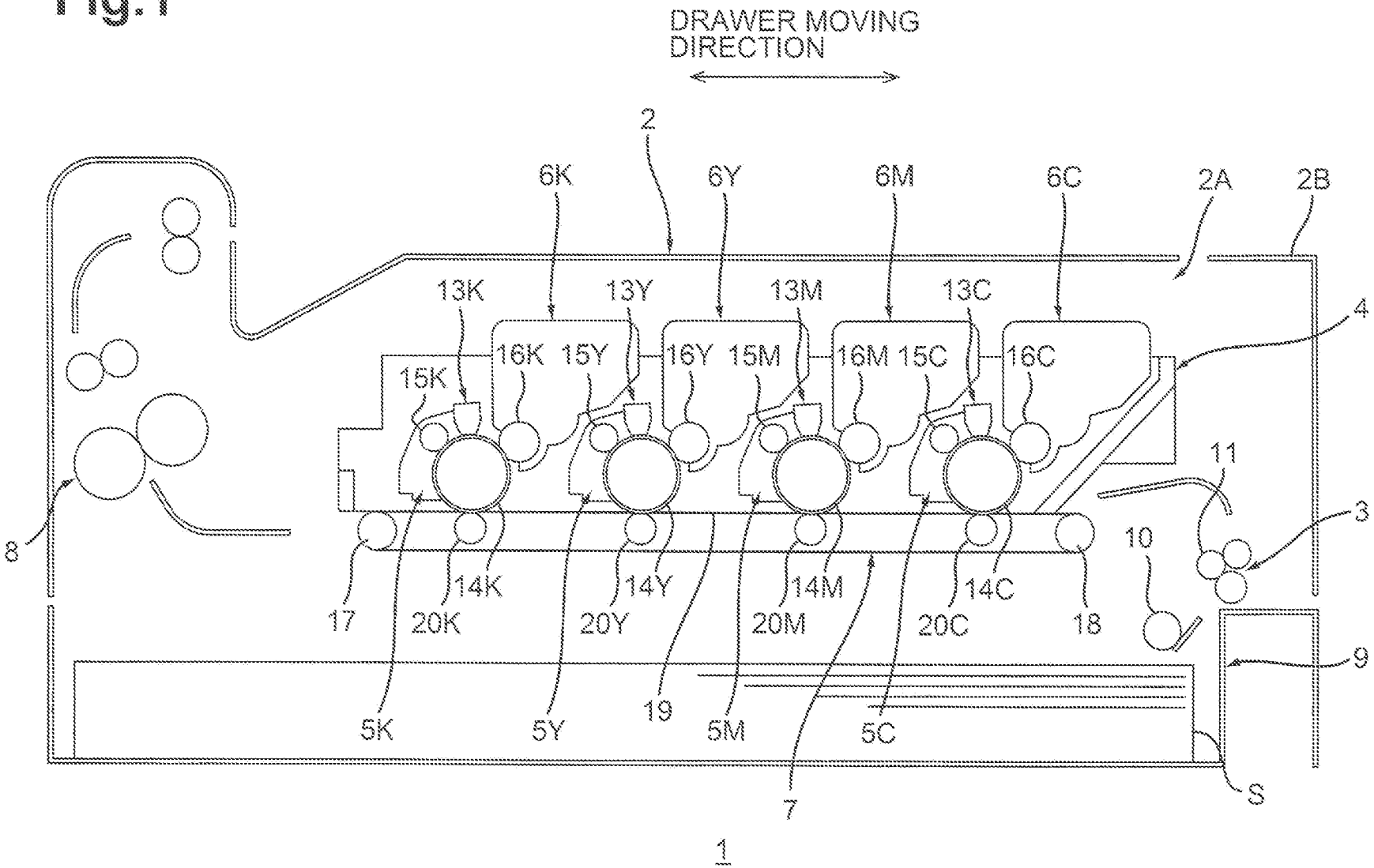
FIG. 1 is a schematic configuration view of an image forming apparatus including a drawer in a first illustrative embodiment according to one or more aspects of the disclosure, wherein the drawer is located at an inside position.
Figure 2:
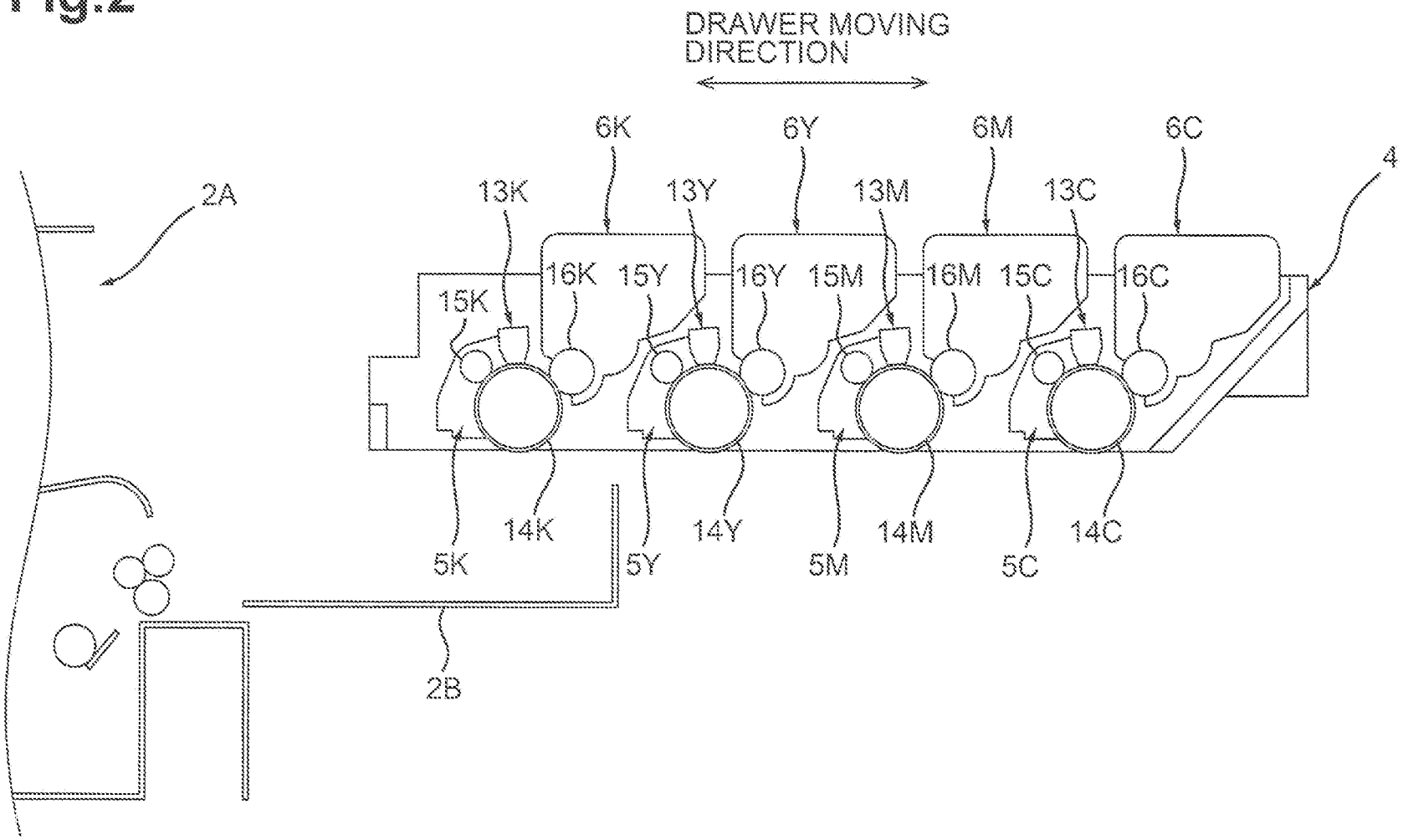
FIG. 2 is a partial schematic view of the image forming apparatus in the first illustrative embodiment according to one or more aspects of the disclosure, wherein the drawer is located at an outside position

Referring to FIGS. 1 and 2, an image forming apparatus 1 will be described. As illustrated in FIG. 1, a top-bottom direction may be defined with reference to an orientation of the image forming apparatus 1 that may be disposed in an orientation in which it may be intended to be used.

As illustrated in FIG. 1, the image forming apparatus 1 includes a housing 2, a feed unit 3, a drawer 4, a plurality of drum cartridges 5K, 5Y, 5M, and 5C, a plurality of developer cartridges 6K, 6Y, 6M, and 6C, a belt unit 7, and a fixing device 8.

1.1 Housing

The housing 2 includes an exterior of the image forming apparatus 1. The housing 2 accommodates therein the feed unit 3, the drawer 4, the drum cartridges 5K, 5Y, 5M, and 5C, the developer cartridges 6K, 6Y, 6M, and 6C, the belt unit 7, and the fixing device 8. The housing 2 has an opening 2A. The opening 2A is located across the drawer 4 from the fixing device 8 when the drawer 4 is fully located within the housing 2 (hereinafter, this position of the drawer 4 is referred to as an "inside position"). The housing 2 further includes a cover 2B. The cover 2B is pivotable between a covering position (refer to FIG. 1) that enables the cover 2B to cover the opening 2A and an uncovering position (refer to FIG. 2) that enables the cover 2B to uncover the opening 2A.

1.2 Feed Unit

The feed unit 3 is configured to feed one or more sheets S, one by one, toward a photosensitive drum 14C. The sheet S may be, for example, a recording sheet. The feed unit 3 includes a feed tray 9, a pickup roller 10, and feed rollers 11. The feed tray 9 is configured to support one or more sheets S. The pickup roller 10 is configured to pick up and convey a sheet S from the feed unit 9 toward the feed rollers 11. The feed rollers 11 are configured to further convey the sheet S conveyed by the pickup roller 10 toward the photosensitive drum 14C.

1.3 Drawer

As illustrated in FIG. 2, the drawer 4 is configured to, when the cover 2B is located at the uncovering position, move between the inside position (refer to FIG. 1) and an outside position (refer to FIG. 2). When the drawer 4 is located at the inside position, the drawer 4 is within the housing 2. When the drawer 4 is located at the outside position, the drawer 4 is out of the housing 2. A direction in which the drawer 4 moves between the inside position and the outside position is defined as a drawer moving direction. As illustrated in FIG. 1, the drawer 4 includes a plurality of, for example, four exposure heads 13K, 13Y, 13M, and 13C.

The exposure heads 13K, 13Y, 13M, and 13C are spaced apart from each other in the drawer moving direction. In a state where the drum cartridges 5K, 5Y, 5M, and 5C are fully attached to the drawer 4 (e.g., when the drum cartridges are in respective operating positions), the exposure heads 13K, 13Y, 13M, and 13C are located above the photosensitive drums 14K, 14Y, 14M, and 14C, respectively. The exposure head 13K is configured to expose a circumferential surface of the photosensitive drum 14K. The exposure head 13Y is configured to expose a circumferential surface of the photosensitive drum 14Y. The exposure head 13M is configured to expose a circumferential surface of the photosensitive drum 14M. The exposure head 13C is configured to expose a circumferential surface of the photosensitive drum 14C.

1.4 Drum Cartridges

Each of the drum cartridges 5K, 5Y, 5M, and 5C is attachable to and detachable from the drawer 4 when the drawer 4 is located at the outside position (refer to FIG. 2). In a state where the drum cartridges 5K, 5Y, 5M, and 5C are fully attached to the drawer 4, the drum cartridges 5K, 5Y, 5M, and 5C are spaced apart from each other in the drawer moving direction.

The drum cartridge 5K includes the photosensitive drum 14K and a charger 15K.

In a state where the drum cartridge 5K is in a drum cartridge operating position, and therefore fully attached to the drawer 4, the photosensitive drum 14K is rotatable on its axis extending in a width direction (refer to FIG. 4) of the drawer 4. The width direction may be orthogonal to the drawer moving direction and the top-bottom direction. The photosensitive drum 14K extends along its axis. The photosensitive drum 14K has a cylindrical shape. The photosensitive drum 14K has a diameter of 20 mm or greater and less than 28 mm.

The charger 15K is configured to charge the circumferential surface of the photosensitive drum 14K. After the charger 15K charges the circumferential surface of the photosensitive drum 14K, the exposure head 13K exposes the charged circumferential surface of the photosensitive drum 14K to form an electrostatic latent image thereon. In a state where the drum cartridge 5K is in the drum cartridge operating position, and therefore fully attached to the drawer 4, the charger 15K is located upstream from the exposure head 13K in a rotating direction of the photosensitive drum 14K. The charger 15K may be, for example, a charge roller. Nevertheless, in other embodiments, for example, the charger 15K may be a scorotron charger.

The drum cartridge 5Y includes a photosensitive drum 14Y and a charger 15Y. The drum cartridge 5M includes a photosensitive drum 14M and a charger 15M. The drum cartridge 5C includes a photosensitive drum 14C and a charger 15C. All of the drum cartridges 5Y, 5M, and 5C have the same or similar configuration to the drum cartridge 5K. Therefore, like numerals are used for like corresponding components and a detailed explanation for the drum cartridges 5Y, 5M, and 5C will be omitted.

1.5 Developer Cartridges

When the drawer 4 is located at the outside position (refer to FIG. 2), each of the developer cartridges 6K, 6Y, 6M, and 6C is attachable to and detachable from the drawer 4. In a state where the developer cartridges 6K, 6Y, 6M, and 6C are fully attached to the drawer 4 (e.g., in developer cartridge operating positions, respectively), the developer cartridges 6K, 6Y, 6M, and 6C are spaced apart from each other in the drawer moving direction.

The developer cartridge 6K is configured to store toner to be supplied onto the circumferential surface of the photosensitive drum 14K. The developer cartridge 6K includes a developing roller 16K. In a state where the drum cartridge 5K is in a drum cartridge operating position and therefore fully attached to the drawer 4, the charger 15K of the drum cartridge 5K is located across the exposure head 13K from the developing roller 16K in the drawer moving direction.

The developing roller 16K is configured to supply toner from the developer cartridge 6K onto the circumferential surface of the photosensitive drum 14K. Toner is supplied from the developer cartridge 6K onto the circumferential surface of the photosensitive drum 14K having an electrostatic latent image to develop the electrostatic latent image. Thus, a toner image is formed on the circumferential surface of the photosensitive drum 14K. In other words, the toner image is formed on the circumferential surface of the photosensitive drum 14K by development of the electrostatic latent image formed on the circumferential surface of the photosensitive drum 14K due to electrostatic movement of toner from the developing roller 16K to the circumferential surface of the photosensitive drum 14. The developing roller 16K is partially accommodated in the developer cartridge 6K. In a state where the drum cartridge 5K and the developer cartridge 6K are in the drum cartridge operating position and developer cartridge operating position, and therefore both fully attached to the drawer 4, the developing roller 16K is located downstream from the exposure head 13K in the rotating direction of the photosensitive drum 14K. In such a state, the developing roller 16K contacts the circumferential surface of the photosensitive drum 14K.

The developer cartridge 6Y is configured to store toner to be supplied to the circumferential surface of the photosensitive drum 14Y, and includes a developing roller 16Y. The developer cartridge 6M is configured to store toner to be supplied to the circumferential surface of the photosensitive drum 14M, and includes a developing roller 16M. The developer cartridge 6C is configured to store toner to be supplied to the circumferential surface of the photosensitive drum 14C, and includes a developing roller 16C. All of the developer cartridges 6Y, 6M, and 6C have the same or similar configuration to the developer cartridge 6K. Therefore, like numerals are used for like corresponding components and a detailed explanation for the developer cartridges 6Y, 6M, and 6C will be omitted.

1.6 Belt Unit

The belt unit 7 is configured to convey a sheet S fed from the feed unit 3 toward the fixing device 8 and transfer toner images, which were formed on the circumferential surfaces of the respective photosensitive drums 14K, 14Y, 14M, and 14C, to the sheet S being conveyed. The belt unit 7 includes a drive roller 17, a tension roller 18, a belt 19, and a plurality of, for example, four transfer rollers 20K, 20Y, 20M, and 20C.

The drive roller 17 is configured to apply a driving force to the belt 19. The drive roller 17 is disposed between the tension roller 18 and the fixing device 8 in the drawer moving direction.

The tension roller 18 is configured to apply tension to the belt 19. The tension roller 18 is spaced from the drive roller 17 in the drawer moving direction.

The belt 19 is configured to convey a sheet S fed from the feed unit 3 toward the fixing device 8. The belt 19 may be, for example, an endless belt. The belt 19 is looped around the drive roller 17 and the tension roller 18. The belt 19 is configured to, when the drawer 4 having the drum cartridges 5K, 5Y, 5M, and 5C is located at the inside position, contact all of the photosensitive drums 14K, 14Y, 14M, and 14C via its outer circumferential surface. The belt 19 is configured to rotate around the drive roller 17 and the tension roller 18. When the belt 19 rotates, the belt 19 passes between the plurality of photosensitive drums 14K, 14Y, 14M, and 14C which are located above the belt 19, and the plurality of transfer rollers 20K, 20Y, 20M, and 20C which are located below the belt 19.

The transfer rollers 20K, 20Y, 20M, and 20C are disposed between the drive roller 17 and the tension roller 18 in the drawer moving direction. The transfer roller 20K is configured to, when a sheet S being conveyed by the belt 19 contacts the photosensitive drum 14K, transfer a toner image onto the sheet S from the circumferential surface of the photosensitive drum 14K. When the drawer 4 having the drum cartridge 5K is located at the inside position, the transfer roller 20K is located below the photosensitive drum 14K. All of the transfer rollers 20Y, 20M, and 20C have the same or similar configuration to the transfer roller 20K. Therefore, a detailed explanation for the transfer rollers 20Y, 20M, and 20C will be omitted.

1.7 Fixing Device

The fixing device 8 is configured to apply heat and pressure to a sheet S, on which a toner image has been transferred, to fix the transferred image to the sheet S. The sheet S that has passed the fixing device 8 is then discharged onto an upper surface of the housing 2.

2. Details of Drum Cartridges

Figure 3A:
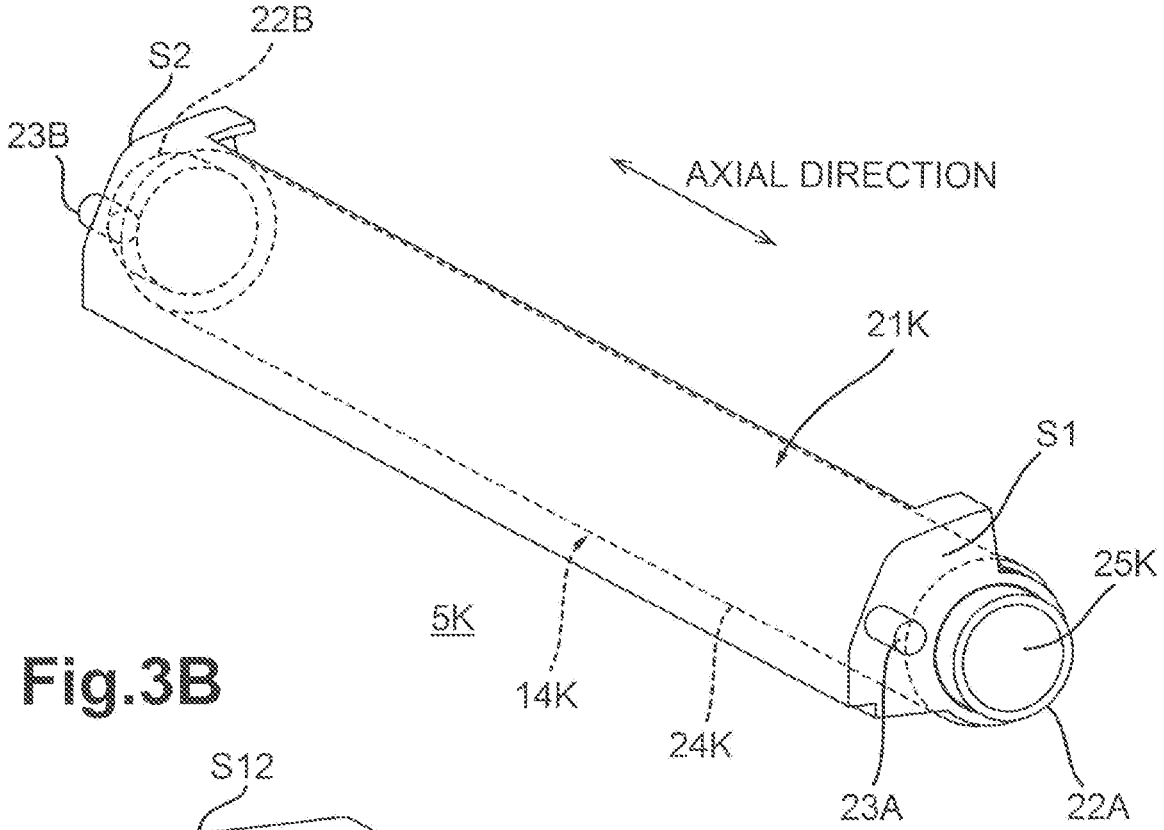
FIG. 3A is a perspective view of one of drum cartridges in the first illustrative embodiment according to one or more aspects of the disclosure.

Referring to FIG. 3A, the drum cartridge 5K will be described in detail.

The drum cartridge 5K further includes a frame 21K, protrusions 22A and 22B, and protrusions 23A and 23B in addition to the photosensitive drum 14K and the charger 15K (refer to FIG. 1).

The frame 21K supports the photosensitive drum 14K and the charger 15K. The frame 21K covers at least a portion of the photosensitive drum 14K and the charger 15K. The frame 21K extends along a direction in which the axis of the photosensitive drum 14K extends. The direction in which the axis of the photosensitive drum 14K extends is defined as an axial direction. The frame 21K has exterior surfaces S1 and S2. The exterior surface S1 defines one end of the frame 21K in the axial direction. The exterior surface S2 defines the other end of the frame 21K in the axial direction.

The protrusion 22A is located at the exterior surface S1. In one example, the protrusion 22A and the frame 21K may have a one piece structure such that the protrusion 22A inseparably extends from the exterior surface S1. In another example, the protrusion 22A may be a separate component from the frame 21K and may be attached to the exterior surface S1. That is, the frame 21K may include the protrusion 22A as an inseparable component to form a one piece structure or may include the protrusion 22A as a separable component that is attached to the frame 21K. The protrusion 22A protrudes from the exterior surface S1. The protrusion 22A extends in the axial direction. The protrusion 22A has a hollow cylindrical shape. The protrusion 22A is engaged with one end portion of the photosensitive drum 14K in the axial direction. That is, the protrusion 22A receives and supports the one end portion of the photosensitive drum 14K in the axial direction. The photosensitive drum 14K includes a drum body 24K, one flange (e.g., a flange 25K), and the other flange (not illustrated). The drum body 24K extends in the axial direction. The drum body 24K has a hollow cylindrical shape. The flange 25K is attached to the one end of the drum body 24K in the axial direction. The other flange is attached to the other end of the drum body 24K in the axial direction. That is, the drum cartridge 14K includes the flanges at its respective ends in the axial direction. The flange 25K is engaged with the protrusion 22A. During attachment of the drum cartridge 5K to the drawer 4, the protrusion 22A is engaged with a protrusion guide 44K of a side frame 41A of the drawer 4 (refer to FIG. 4).

The protrusion 22B is located at the exterior surface S2. The protrusion 22B has the same shape as the protrusion 22A (e.g., a cylindrical shape). The other flange of the photosensitive drum 14K is engaged with the protrusion 22B. During attachment of the drum cartridge 5K to the drawer 4, the protrusion 22B is engaged with a protrusion guide 44K of a side frame 41B of the drawer 4 (refer to FIG. 4).

The protrusion 23A is located at the exterior surface S1. The protrusion 23A protrudes from the exterior surface S1 at a different position from the protrusion 22A. The protrusion 23A extends in the axial direction. The protrusion 23A has a solid cylindrical shape. During attachment of the drum cartridge 5K to the drawer 4, the protrusion 23A is engaged with a protrusion guide 45K of the side frame 41A of the drawer 4 (refer to FIG. 4).

The protrusion 23B is located at the exterior surface S2. The protrusion 23B has the same shape as the protrusion 23A (e.g., a solid cylindrical shape). During attachment of the drum cartridge 5K to the drawer 4, the protrusion 23B is engaged with a protrusion guide 45K of the side frame 41B of the drawer 4 (refer to FIG. 4).

3. Details of Developer Cartridges

Figure 3B:
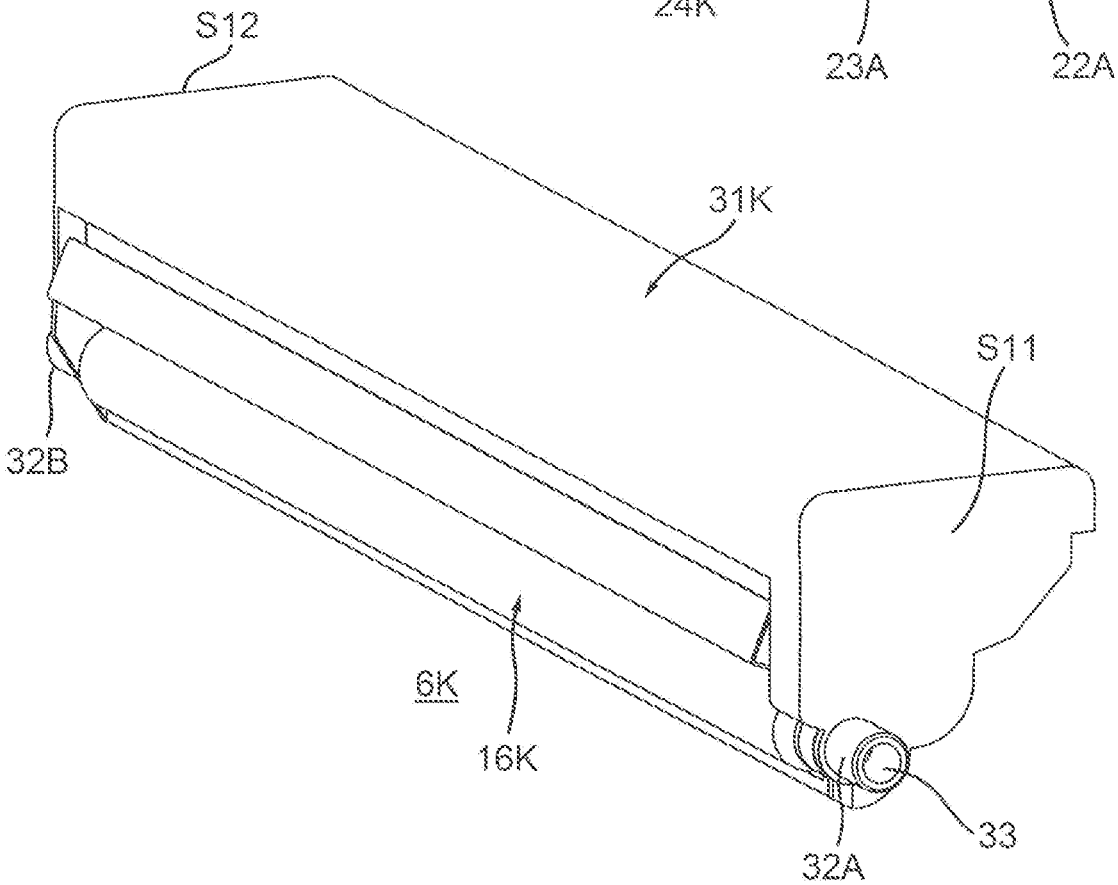
FIG. 3B is a perspective view of one of developer cartridges in the first illustrative embodiment according to one or more aspects of the disclosure.

Referring to FIG. 3B, the developer cartridge 6K will be described in detail.

As illustrated in FIG. 3B, the developer cartridge 6K further includes a housing 31K, and protrusions 32A and 32B, in addition to the developing roller 16K.

The housing 31K of the developer cartridge 6K is capable of storing toner. The housing 31K supports the developing roller 16K attached thereto. The housing 31K is elongated and hollow. The housing 31K extends along a direction in which an axis of the developing roller 16K extends. The housing 31K has exterior surfaces S11 and S12. The exterior surface S11 defines one end of the housing 31K in the direction in which the axis of the developing roller 16K extends. The exterior surface S12 defines the other end of the housing 31K in the direction in which the axis of the developing roller 16K extends. The housing 31K may include a gear cover. In such a case, the gear cover may define the one end of the housing 31K in the direction in which the axis of the developing roller 16K extends, and may have the exterior surface S11.

The protrusion 32A is located at the exterior surface S11. The protrusion 32A protrudes from the exterior surface S11. The protrusion 32A extends along the direction in which the axis of the developing roller 16K extends. The protrusion 32A has a hollow cylindrical shape. The developing roller 16 includes a shaft 33. In one example, one end portion of the shaft 33 of the developing roller 16 may be engaged with the protrusion 32A. In another example, the one end portion of the shaft 33 of the developing roller 16 may function as the protrusion 32A. During attachment of the developing cartridge 6K to the drawer 4, the protrusion 32A is engaged with a protrusion guide 43K of the side frame 41A of the drawer 4 (refer to FIG. 4).

The protrusion 32B is located at the exterior surface S12. The protrusion 32B protrudes from the exterior surface S12. The protrusion 32B has the same shape as the protrusion 32A (e.g., a hollow cylindrical shape). In one example, the other end portion of the shaft 33 of the developing roller 16 may be engaged with the protrusion 32B. During attachment of the developing cartridge 6K to the drawer 4, the protrusion 32B is engaged with a protrusion guide 43K of the side frame 41B of the drawer 4 (refer to FIG. 4).

4. Details of Drawer

Figure 4:
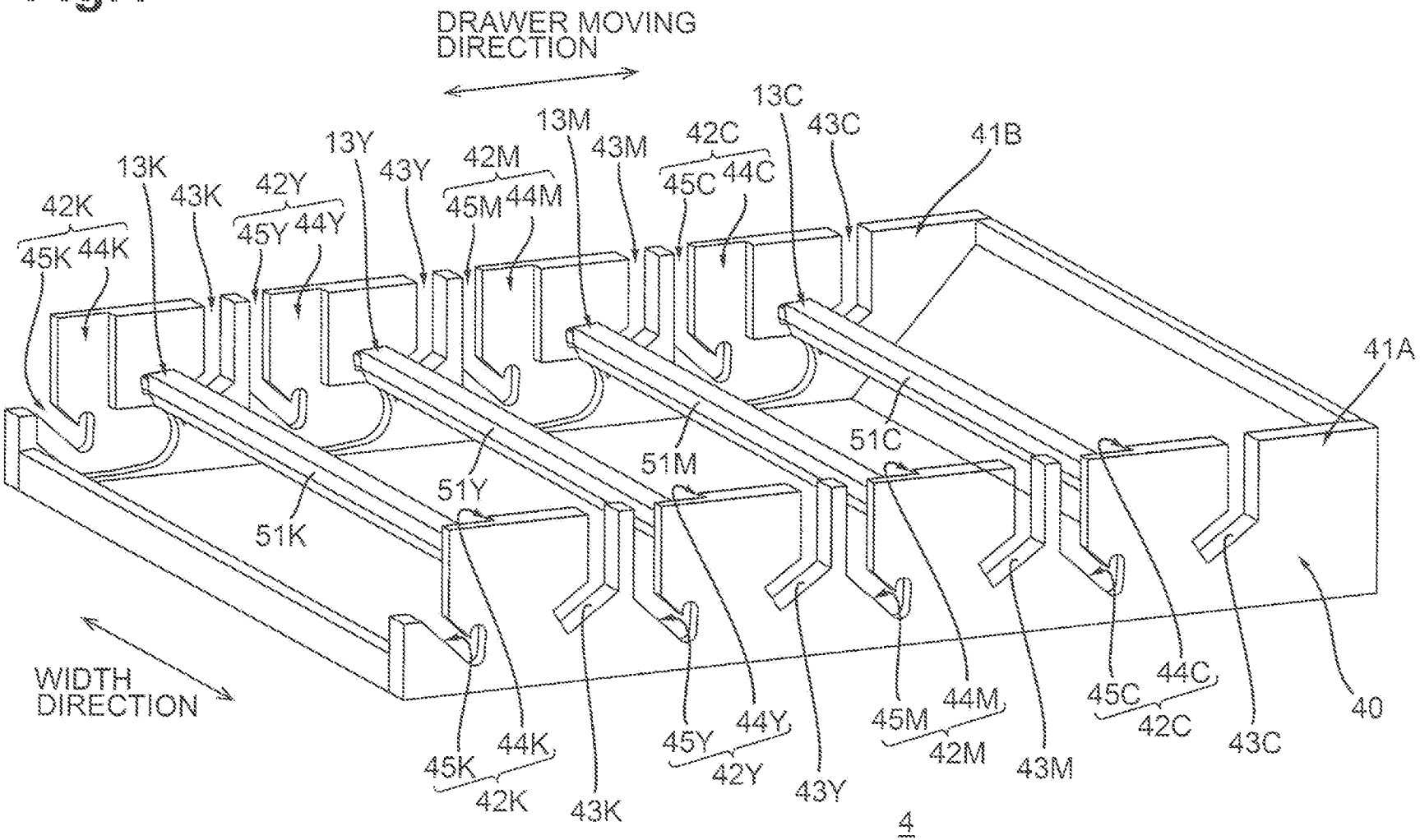
FIG. 4 is a perspective view of the drawer in the first illustrative embodiment according to one or more aspects of the disclosure.
Figure 5:
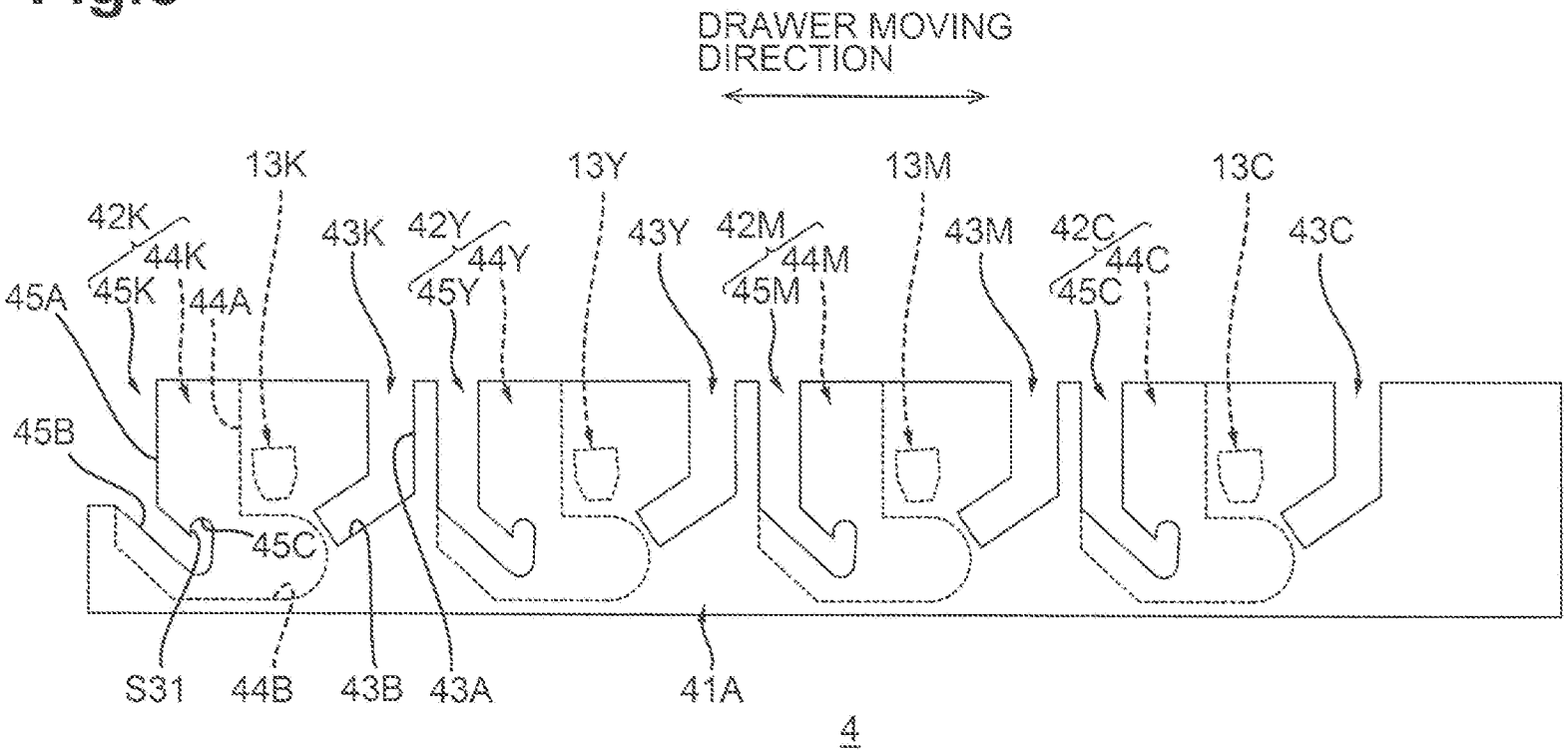
FIG. 5 is a side view of the drawer of FIG. 4 in the first illustrative embodiment according to one or more aspects of the disclosure.

Referring to FIGS. 4 and 5, the drawer 4 will be described in detail.

As illustrated in FIG. 4, the drawer 4 further includes a frame 40 in addition to the exposure heads 13K, 13Y, 13M, and 13C.

The frame 40 is configured such that the drum cartridges 5K, 5Y, 5M, and 5C and the developer cartridges 6K, 6Y, 6M, and 6C are each detachably attachable thereto. The frame 40 includes the side frames 41A and 41B, which extend in the drawer moving direction and face each other in the width direction. The exposure heads 13K, 13Y, 13M, and 13C are disposed between the side frame 41A and the side frame 41B in the width direction. The width direction may be orthogonal to the drawer moving direction and the top-bottom direction. The width direction extends parallel to the axis direction (e.g., the direction in which the axis of the photosensitive drum 14K extends) and the direction in which the axis of the developing roller 16K extends in a state where the drum cartridge 5K and the developer cartridge 6K are fully attached to the drawer 4. The drum cartridges 5K, 5Y, 5M, and 5C and the developer cartridges 6K, 6Y, 6M, and 6C may be located between the side frame 41A and the side frame 41B when in respective drum cartridge operating positions and developer cartridge operating positions, and therefore fully attached to the drawer 4. Each of the side frame 41A and the side frame 41B may have a plate shape. Each of the side frame 41A and the side frame 41B includes a plurality of drum cartridge guides 42K, 42Y, 42M, and 42C and a plurality of developer cartridge guides 43K, 43Y, 43M, and 43C. More specifically, for example, the drawer 4 includes at least the drum cartridge guides 42K, the drum cartridge guides 42Y, the developer cartridge guides 43K, and the developer cartridge guides 43Y. The side frame 41B has the same or similar configuration to the side frame 41A. Therefore, an explanation will be made with respect to the side frame 41A only and a detailed explanation for the side frame 41B will be omitted.

4.1 Drum Cartridge Guides

As illustrated in FIG. 5, in the side frame 41A, the drum cartridge guides 42K, 42Y, 42M, and 42C are spaced apart from each other in the drawer moving direction.

The drum cartridge guide 42K is configured to guide the drum cartridge 5K during attachment of the drum cartridge 5K to the drawer 4. The drum cartridge guide 42K includes the protrusion guide 44K and the protrusion guide 45K.

The protrusion guide 44K is configured to, when the drum cartridge 5K is being attached to the drawer 4, guide the protrusion 22A (refer to FIG. 3A) of the drum cartridge 5K until the photosensitive drum 14K (refer to FIG. 1) reaches below the exposure head 13K. That is, during attachment of the drum cartridge 5K to the drawer 4, the protrusion 22A of the drum cartridge 5K is engaged with the protrusion guide 44K. The protrusion guide 44K may be a groove or recess. In the side frame 41A, the protrusion guide 44K is recessed relative to an inner surface of the side frame 41A in a direction away from the side frame 41B (refer to FIG. 4) with respect to the width direction.

As illustrated in FIG. 5, the protrusion guide 44K includes a first portion 44A and a second portion 44B. The first portion 44A is located across the exposure head 13K from the developer cartridge guide 43K in the drawer moving direction. The first portion 44A extends in the top-bottom direction. The second portion 44B is located below the exposure head 13K. The second portion 44B extends in the drawer moving direction. In a state where the drum cartridge 5K is fully attached to the drawer 4 (refer to FIG. 8), the protrusion 22A of the drum cartridge 5K is engaged with the second portion 44B of the protrusion guide 44K. Thus, the photosensitive drum 14K is enabled be located below the exposure head 13K in a state where the drum cartridge 5K is in the drum cartridge operating position, and therefore fully attached to the drawer 4.

The protrusion guide 45K is configured to, when the drum cartridge 5K is being attached to the drawer 4, guide the protrusion 23A (refer to FIG. 3A) of the drum cartridge 5K until the photosensitive drum 14K (refer to FIG. 1) reaches below the exposure head 13K. That is, during attachment of the drum cartridge 5K to the drawer 4, the protrusion 23A of the drum cartridge 5K is engaged with the protrusion guide 45K. The protrusion guide 45K may be a cut that penetrates the side frame 41A in the width direction. Nevertheless, in other embodiments, for example, the protrusion guide 45K may be a groove. An entire portion of the protrusion guide 45K is located across the exposure head 13K from the developer cartridge guide 43K in the drawer moving direction.

As illustrated in FIG. 5, the protrusion guide 45K includes a first portion 45A, a second portion 45B, and a third portion 45C. The first portion 45A extends in the top-bottom direction. The second portion 45B extends from a lower end of the first portion 45A toward the second portion 44B of the protrusion guide 44K. The second portion 45B is angled relative to the drawer moving direction. More specifically, for example, the second portion 45B is inclined downward toward the exposure head 13K in the drawer moving direction. In other words, a lower portion of the second portion 45B of the protrusion guide 45K is closer to the exposure head 13K in the drawer moving direction. The second portion 45B has one end and the other end in the drawer moving direction. The one end of the second portion 45B is contiguous to the lower end of the first portion 45A of the protrusion guide 45K. The other end of the second portion 45B is closer to the exposure head 13K than the one end the second portion 45B in the drawing moving direction. The third portion 45C extends upward from the other end of the second portion 45B. In a state where the drum cartridge 5K is in the drum cartridge operating position and therefore fully attached to the drawer 4 (refer to FIG. 8), the protrusion 23A of the drum cartridge 5K is engaged with the third portion 45C of the protrusion guide 45K. The third portion 45C has a force receiving surface S31. That is, the drum cartridge guide 42K has the force receiving surface S31. In a state where the drum cartridge 5K and the developer cartridge 6K are in a respective drum cartridge operating position and developer cartridge operating position and therefore both fully attached to the drawer 4 (refer to FIG. 9), the force receiving surface S31 is located across the photosensitive drum 14K from the developer cartridge 6K. The force receiving surface S31 extends in the top-bottom direction, and therefore faces a developer cartridge 6K when such a cartridge is located in the developer cartridge operating position. In a state where the drum cartridge 5K and the developer cartridge 6K are in a respective drum cartridge operating position and developer cartridge operating position and therefore both fully attached to the drawer 4, the force receiving surface S31 extends in a direction intersecting a direction in which the developer cartridge 6K presses the photosensitive drum 14K. Thus, in such a state, the force receiving surface S31 receives a pressing force of the developer cartridge 6K that acts on the photosensitive drum 14K.

The drum cartridge guide 42Y is configured to guide the drum cartridge 5Y during attachment of the drum cartridge 5Y to the drawer 4. The drum cartridge guide 42Y is disposed between the developer cartridge guide 43K and the exposure head 13Y in the drawer moving direction. The drum cartridge guide 42M is configured to guide the drum cartridge 5M during attachment of the drum cartridge 5M to the drawer 4. The drum cartridge guide 42M is disposed between the developer cartridge guide 43Y and the exposure head 13M in the drawer moving direction. The drum cartridge guide 42C is configured to guide the drum cartridge 5C during attachment of the drum cartridge 5C to the drawer 4. The drum cartridge guide 42C is disposed between the developer cartridge guide 43M and the exposure head 13C in the drawer moving direction. The drum cartridge guides 42Y, 42M, and 42C have the same or similar configuration as the drum cartridge guide 42K. Therefore, a detailed explanation for the drum cartridge guides 42Y, 42M, and 42C will be omitted.

4.2 Developer Cartridge Guides

The developer cartridge guides 43K, 43Y, 43M, and 43C are spaced apart from each other in the drawer moving direction.

The developer cartridge guide 43K is configured to guide the developer cartridge 6K during attachment of the developer cartridge 6K to the drawer 4. The developer cartridge guide 43K is configured to, during attachment of the developer cartridge 6K to the drawer 4, guide the protrusion 32A (refer to FIG. 3B) of the developer cartridge 6K until the developing roller 16K contacts the photosensitive drum 14K. That is, during attachment of the developer cartridge 6K to the drawer 4, the protrusion 32A of the developer cartridge 6K is engaged with the developer cartridge guide 43K. The developer cartridge guide 43K may be a cut that penetrates the side frame 41A in the width direction. Nevertheless, in other embodiments, for example, the developer cartridge guide 43K may be a groove. An entire portion of the developer cartridge guide 43K is located across the exposure head 13K from the protrusion guide 45K in the drawer moving direction.

As illustrated in FIG. 5, the developer cartridge guide 43K includes a first portion 43A and a second portion 43B. The first portion 43A is farthest from the drum cartridge guide 42K in the drawer moving direction among any portions of the developer cartridge guide 43K. The first portion 43A extends in the top-bottom direction. The second portion 43B is closest to the drum cartridge guide 42K in the drawer moving direction among any portions of the developer cartridge guide 43K. In other words, the second portion 43B is closer to the drum cartridge guide 42K than the first portion 43A in the drawer moving direction. The second portion 43B extends from a lower end of the first portion 43A toward the second portion 44B of the protrusion guide 44K. In a state where the developer cartridge 6K is in a developer cartridge operating position and therefore fully attached to the drawer 4 (refer to FIG. 9), the protrusion 32A of the developer cartridge 6K is engaged with the second portion 43B of the developer cartridge guide 43K.

The second portion 43B is angled relative to the drawer moving direction. More specifically, for example, the second portion 43B is inclined downward toward the exposure head 13K in the drawer moving direction. In other words, a lower portion of the second portion 43B of the developer cartridge guide 43K is closer to the exposure head 13K in the drawer moving direction.

The developer cartridge guide 43Y is configured to guide the developer cartridge 6Y during attachment of the developer cartridge 6Y to the drawer 4. The developer cartridge guide 43M is configured to guide the developer cartridge 6M during attachment of the developer cartridge 6M to the drawer 4. The developer cartridge guide 43C is configured to guide the developer cartridge 6C during attachment of the developer cartridge 6C to the drawer 4. All of the developer cartridge guides 43Y, 43M, and 43C have the same or similar configuration as the developer cartridge guide 43K. Therefore, a detailed explanation for the developer cartridge guides 43Y, 43M, and 43C will be omitted.

4.3 Exposure Heads

The exposure head 13K is disposed between the drum cartridge guide 42K and developer cartridge guide 43K in the drawer moving direction. More specifically, for example, the exposure head 13K is disposed between the first portion 45A of the protrusion guide 45K of the drum cartridge guide 42K and the first portion 43A of the developer cartridge guide 43K in the drawer moving direction. As illustrated in FIG. 4, the exposure unit 13K is supported by the frame 40 of the drawer 4. The exposure head 13K extends in the width direction of the drawer 4.

More specifically, for example, the exposure head 13K includes a frame 51K and an LED array (not illustrated). The frame 51K accommodates the LED array therein. The frame 51K extends in the width direction of the drawer 4. The frame 51K is elongated and hollow. In a state where the drum cartridge 5K is fully attached to the drawer 4, the LED array is spaced from the photosensitive drum 14K by a predetermined gap. The LED array includes a plurality of LEDs. The LEDs are aligned along the width direction of the drawer 4. That is, in a state where the drum cartridge 5K is fully attached to the drawer 4, the LEDs are aligned along the axial direction.

In a state where the drum cartridge 5K is in a drum cartridge operating position, it can be said that the drum cartridge 5K is fully attached to the drawer 4, at least the LED array of the exposure head 13K is fixedly positioned relative to the photosensitive drum 14K. In one example, the LED array may be fixed to the frame 51K of the exposure head 13K and the frame 51K may be supported by the frame 40 of the drawer 4 so as to be movable relative to the frame 40. In such a case, the frame 51K of the exposure head 13K may be movable relative to the frame 40 of the drawer 4 such that the position of the LED array may be adjusted relative to the photosensitive drum 14K. In another example, the frame 51K of the exposure head 13K may be fixed relative to the frame 40 of the drawer 4 and the LED array may be movable relative to frame 51K of the exposure head 13K.

The exposure head 13Y is disposed between the drum cartridge guide 42Y and developer cartridge guide 43Y in the drawer moving direction. The exposure head 13M is disposed between the drum cartridge guide 42M and developer cartridge guide 43M in the drawer moving direction. The exposure head 13C is disposed between the drum cartridge guide 42C and developer cartridge guide 43C in the drawer moving direction. All of the exposure heads 13Y, 13M, and 13C have the same or similar configuration as the exposure head 13K. Therefore, a detailed explanation for the exposure heads 13Y, 13M, and 13C will be omitted.

5. Attaching of Drum Cartridge and Developer Cartridge to Drawer

Referring to FIGS. 6 to 9, an explanation will be made on how to attach the drum cartridge 5K and the developer cartridge 6K to the drawer 4.

Figure 6:
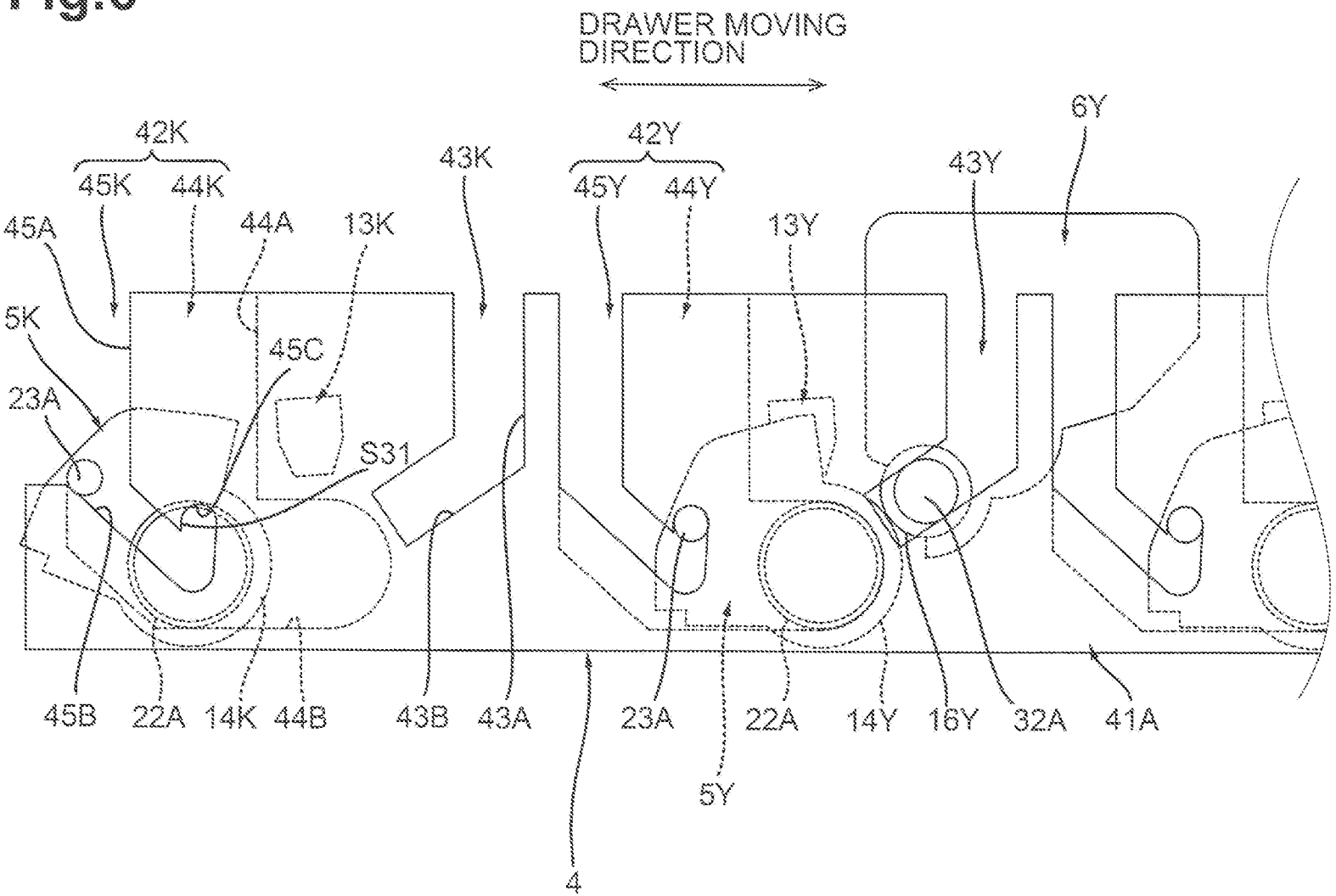
FIG. 6 is an explanatory diagram for explaining how to attach the drum cartridge of FIG. 3A to the drawer of FIG. 4 in the first illustrative embodiment according to one or more aspects of the disclosure, wherein one protrusion and the other protrusion of the drum cartridge are engaged with one protrusion guide and the other protrusion guide, respectively, of the drawer.

For attaching the drum cartridge 5K to the drawer 4, as illustrated in FIG. 6, a user inserts the drum cartridge 5K into the drawer 4 such that the protrusion 22A of the drum cartridge 5K is engaged with the protrusion guide 44K and the protrusion 23A of the drum cartridge 5K is engaged with the protrusion guide 45K.

Figure 7:
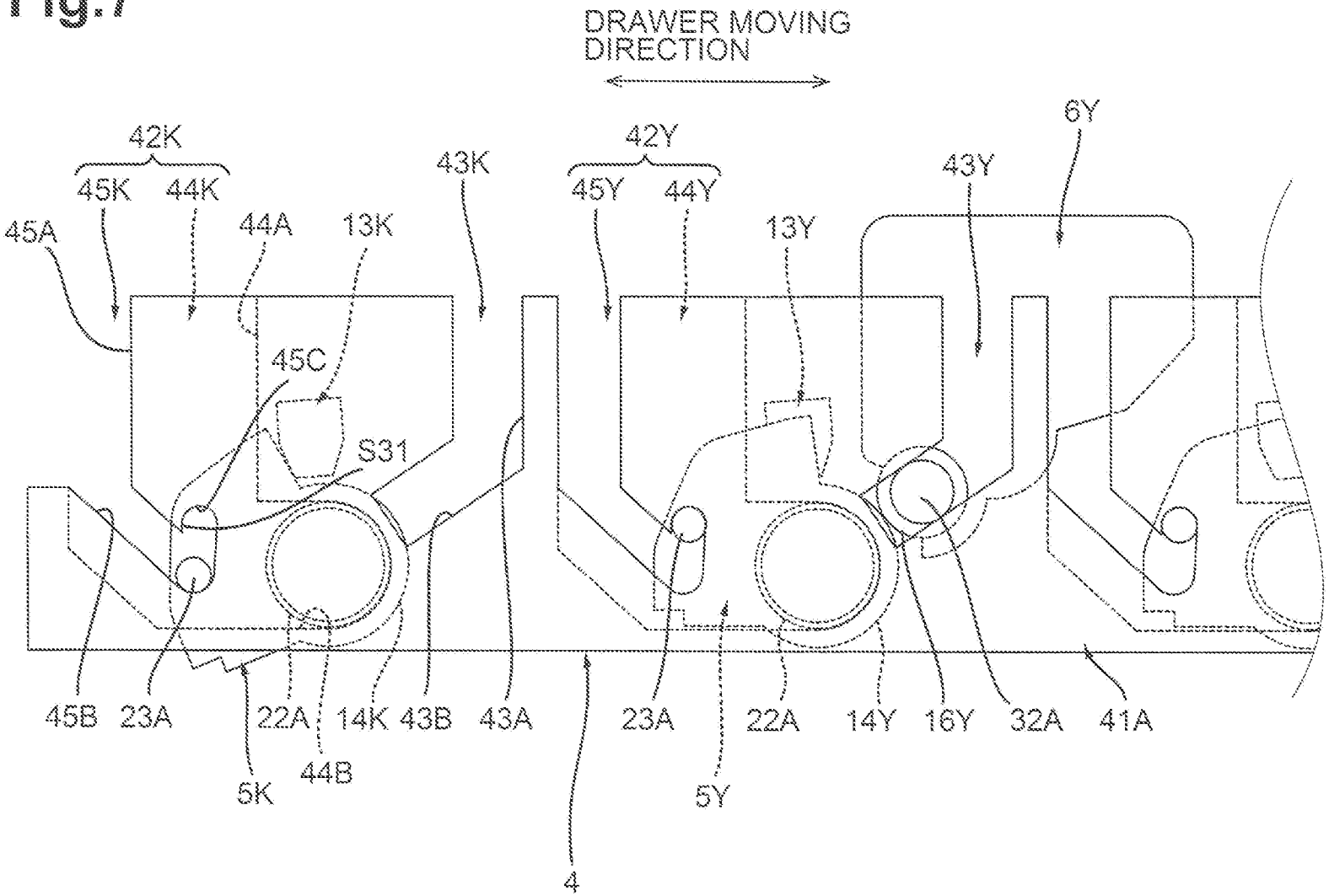
FIG. 7 is an explanatory diagram continued from FIG. 6 in the first illustrative embodiment according to one or more aspects of the disclosure, wherein the one protrusion is engaged with a second portion of the one protrusion guide and a photosensitive drum is located below an exposure head.

As illustrated in FIGS. 6 and 7, the drum cartridge 5K is moved in the drawer 4 along an attaching route defined across the exposure head 13K from the developer cartridge guide 43K in the drawer moving direction. That is, the drum cartridge 5K is attachable to the drawer 4 from the side opposite to the side where the developer cartridge 6K (refer to FIG. 9) is attached with respect to the exposure head 13K in the drawer moving direction.

During the attachment of the drum cartridge 5K, the protrusion 22A of the drum cartridge 5K is guided by the protrusion guide 44K and is then engaged with the second portion 44B of the protrusion guide 44K (refer to FIG. 7). Thus, the photosensitive drum 14K is positioned below the exposure head 13K (refer to FIG. 1).

During the attachment of the drum cartridge 5K, the protrusion 23A of the drum cartridge 5K is guided by the protrusion guide 45K and is then engaged with the second portion 45B of the protrusion guide 45K (refer to FIG. 7). Thus, the protrusion 23A is positioned below the third portion 45C of the protrusion guide 45K. When the drum cartridge 5K is in a state illustrated in FIG. 7, the position of the exposure head 13 is not fixed relative to the photosensitive drum 14K and thus the drum cartridge 5K may be detached from the drawer 4. Accordingly, the drum cartridge 5K is not yet fully attached to the drawer, and not in a drum cartridge operating position.

Figure 8:
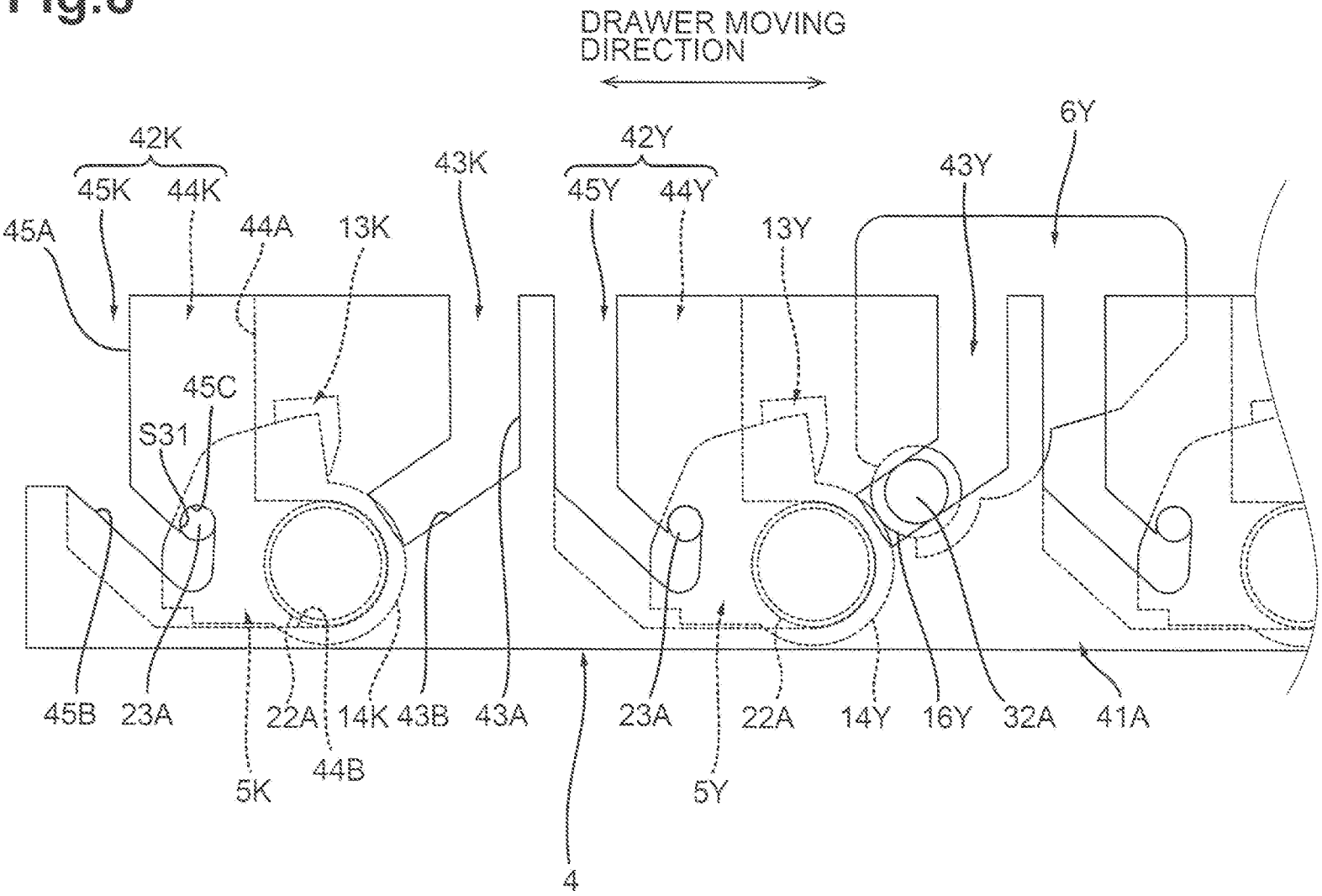
FIG. 8 is an explanatory diagram continued from FIG. 7 in the first illustrative embodiment according to one or more aspects of the disclosure, wherein the other protrusion is engaged with a third portion of the other protrusion guide and the drum cartridge is fully attached to the drawer.

Thereafter, as illustrated in FIGS. 7 and 8, the user rotates the drum cartridge 5K on the protrusion 22A of the drum cartridge 5K such that the protrusion 23A of the drum cartridge 5K moves toward the third portion 45C of the protrusion guide 45K. That is, when the frame 40 of the drawer 4 is located at the outside position, the drum cartridge 5K is rotatable between a first position (refer to FIG. 8) and a second position (refer to FIG. 7) with being placed in the frame 40. The drum cartridge 5K may rotate in the same direction as the rotating direction of the photosensitive drum 14K. Therefore, the protrusion 23A of the drum cartridge 5K may be reduced or prevented from being disengaged from the third portion 45C of the protrusion guide 45K when the photosensitive drum 14K rotates.

In response to rotation of the drum cartridge 5K, as illustrated in FIG. 8, the protrusion 23A of the drum cartridge 5K engages with the third portion 45C of the protrusion guide 45K and contacts the force receiving surface S31. Thus, when the drum cartridge 5K is in a state illustrated in FIG. 8, the position of exposure head 13 is fixed relative to the photosensitive drum 14K and the drum cartridge 5K cannot be detached from the drawer 4.

Through such an attachment procedure, the drum cartridge 5K is fully attached to the drawer 4, and located in a drum cartridge operating position.

Figure 9:
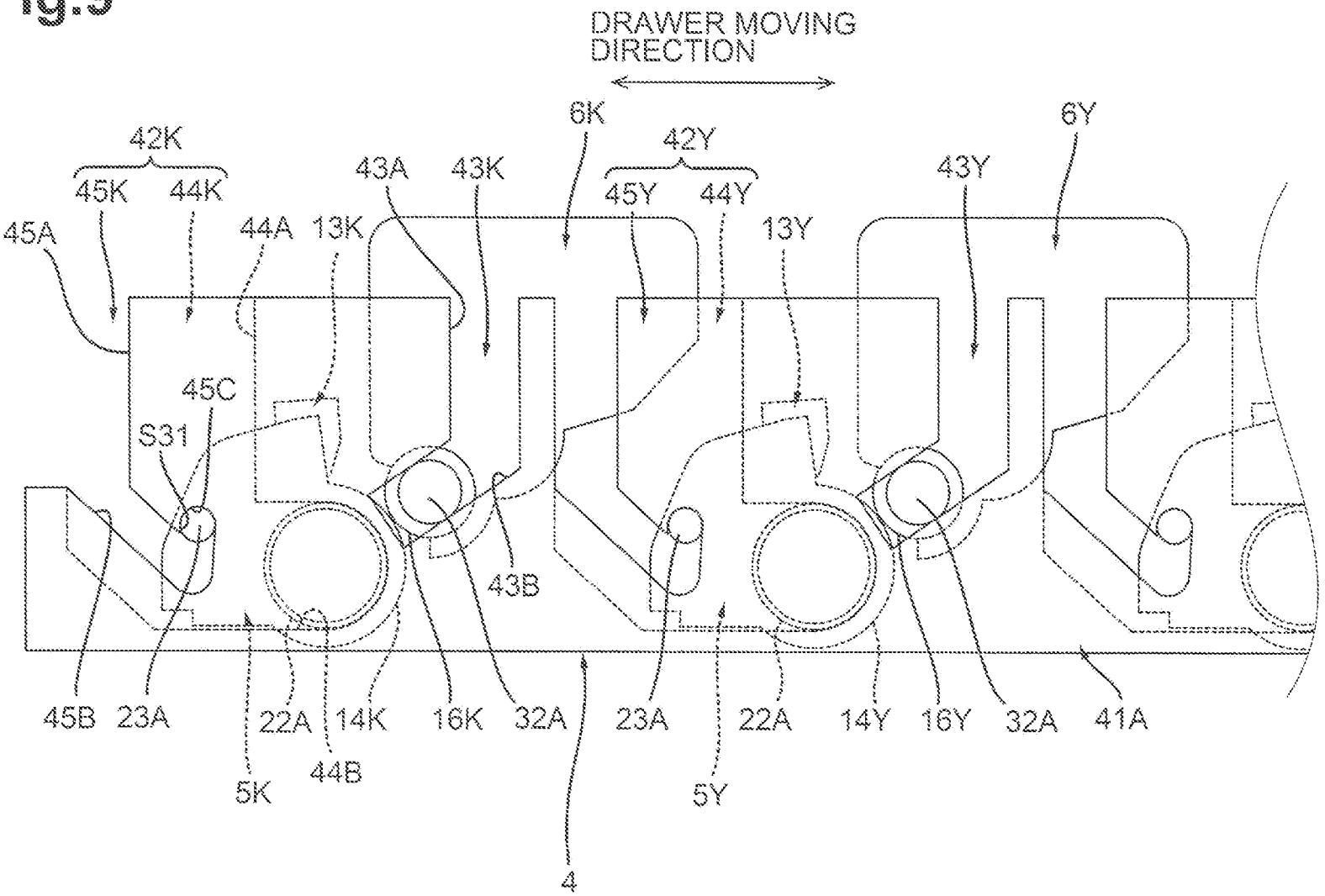
FIG. 9 is an explanatory diagram for explaining how to attach the developer cartridge of FIG. 3B to the drawer of FIG. 4 in the first illustrative embodiment according to one or more aspects of the disclosure.

For attaching the developer cartridge 6K to the drawer 4, as illustrated in FIG. 9, the user inserts the developer cartridge 6K into the drawer 4 such that the protrusion 32A of the developer cartridge 6K is engaged with the developer cartridge guide 43K.

During the attachment of the developer cartridge 6K, the protrusion 32A of the developer cartridge 6K is guided by the developer cartridge guide 43K and is then engaged with the second portion 43B of the developer cartridge guide 43K. Further, the developing roller 16K contacts the photosensitive drum 14K.

During the attachment of the developer cartridge 6K, the developer cartridge 6K is moved in the drawer 4 along an attaching route defined across the exposure head 13K from the drum cartridge guide 42K in the drawer moving direction. That is, the developer cartridge 6K is attachable to the drawer 4 from the side opposite to the side where the drum cartridge 5K (refer to FIG. 9) is attached with respect to the exposure head 13K in the drawer moving direction.

Through such an attachment procedure, the developer cartridge 6K is fully attached to the drawer 4, and positioned in a developer cartridge operating position.

4. Effects

According to the first illustrative embodiment, as illustrated in FIGS. 4 and 5, the drawer 4 includes the exposure head 13K between the drum cartridge guide 42K and the developer cartridge guide 43K in the drawer moving direction.

With this configuration, the exposure head 13K is out of the attaching route of the drum cartridge 5K, and therefore, as illustrated in FIGS. 6 to 8, the drum cartridge 5K is enabled to be attached to the drawer 4 from the side opposite to the side where the developer cartridge 6K (refer to FIG. 9) is attached with respect to the exposure head 13K in the drawer moving direction without contacting the exposure head 13K.

Further, with this configuration, the exposure head 13K is also out of the attaching route of the developer cartridge 6K, and therefore, as illustrated in FIG. 9, the developer cartridge 6K is enabled to be attached to the drawer 4 from the side opposite to the side where the drum cartridge 5K is attached with respect to the exposure head 13K in the drawer moving direction without contacting the exposure head 13K.

Consequently, both of the drum cartridge 5K and the developer cartridge 6K may be enabled to be attached to the drawer 4 including the exposure head 13K without contacting the exposure head 13K. Additionally, the drum cartridge 5K is removable from the drawer 4 without previously removing the developer cartridge 6K.

If, however, the drawer 4 is configured such that the drum cartridge 5K is attached to the drawer 4 from the same side as the side where the developer cartridge 6K is attached although the drum cartridge 5K includes the charger 15K and the drawer 4 is configured such that the exposure head 13K is located between the charger 15K and the developer cartridge 6K in a state where the drum cartridge 5K and the developer cartridge 6K are attached to the drawer 4 (refer to FIG. 1), the exposure head 13K may need to be moved for ensuring the attaching route of the drum cartridge 5K to the drawer 4.

Nevertheless, according to the first illustrative embodiment, the drum cartridge 5K is enabled to be attached to the drawer 4 from the side opposite to the side where the developer cartridge 6K is attached with respect to the exposure head 13K in the drawer moving direction without contacting the exposure head 13K.

Therefore, the drawer 4 does not need to have any configuration for moving the exposure head 13K to ensure the attaching route of the drum cartridge 5K to the drawer 4. Thus, the drawer 4 having such a simple configuration may enable each of the drum cartridge 5K and the developer cartridge 6K to be attached to the drawer 4 including the exposure head 13K.

5. Second Illustrative Embodiment

Referring to FIGS. 10 to 13, a second illustrative embodiment will be described in detail. An explanation will be given mainly for the parts different from the first illustrative embodiment, and an explanation will be omitted for the common components by assigning the same reference numerals thereto.

5.1 Drawer

Figure 10:
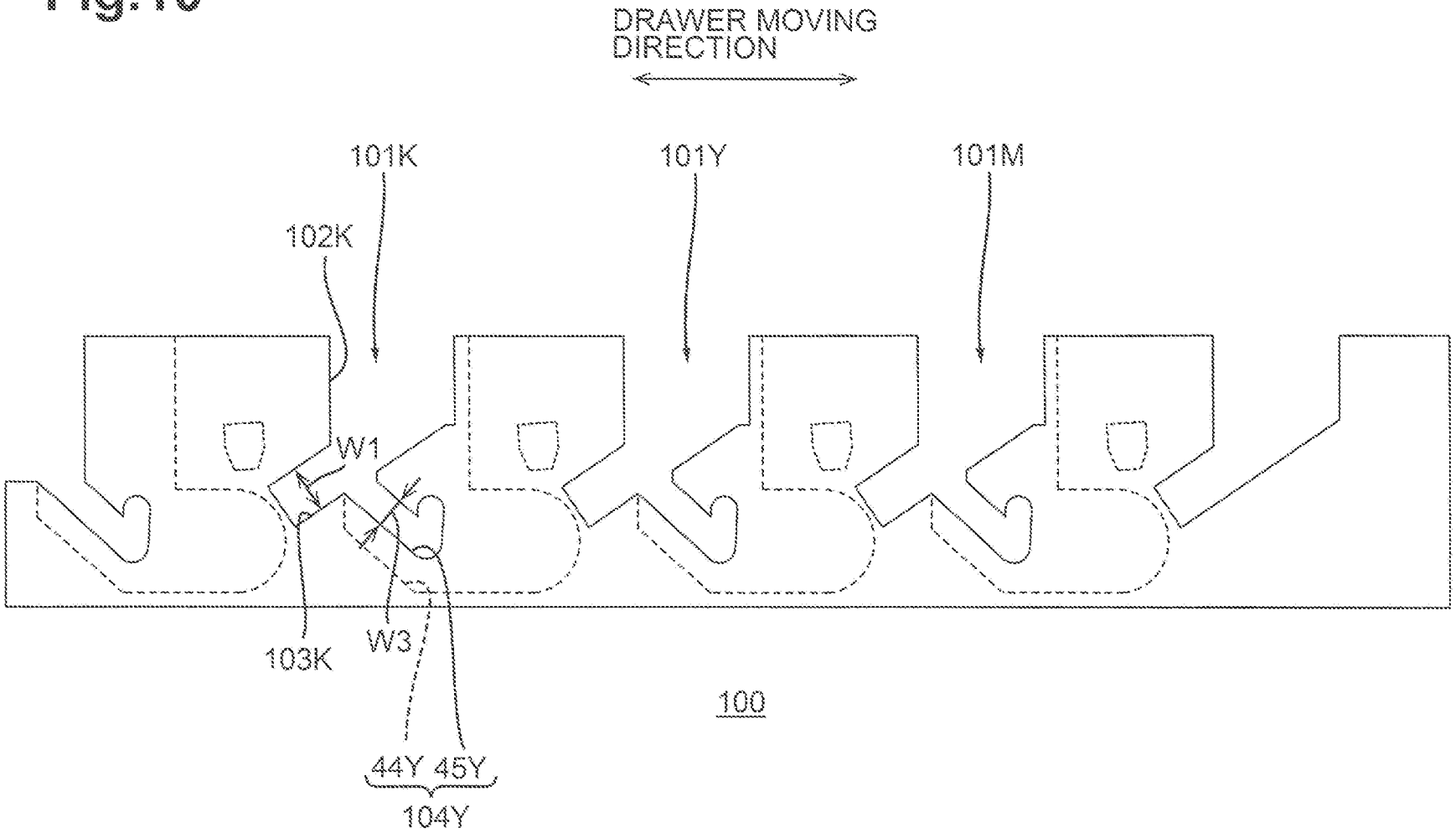
FIG. 10 is a side view of a drawer in a second illustrative embodiment according to one or more aspects of the disclosure.

As illustrated in FIG. 10, a drawer 100 includes a developer cartridge guide 101K, which is substituted for the developer cartridge guide 43K and the drum cartridge guide 42Y of the first illustrative embodiment.

The developer cartridge guide 101K includes a first guide portion 102K, a second guide portion 103K, and a third guide portion 104Y.

5.1.1 First Guide Portion

The first guide portion 102K (refer to FIG. 11) is configured to guide a drum cartridge 110Y during attachment of the drum cartridge 110Y to the drawer 100. The first guide portion 102K is further configured to guide the developer cartridge 6K during attachment of the developer cartridge 6K to the drawer 100. During attachment of the drum cartridge 110Y to the drawer 100, the protrusion 22A and the protrusion 23A of the drum cartridge 110Y are engaged with the first guide portion 102K. During attachment of the developer cartridge 6K to the drawer 100, the protrusion 32A of the developer cartridge 6K is engaged with the first guide portion 102K. The first guide portion 102K extends in the top-bottom direction. The first guide portion 102K may be a cut that penetrates the side frame 41A in the width direction. Nevertheless, in other embodiments, for example, the first guide portion 102K may be a groove.

5.1.2 Second Guide Portion

The second guide portion 103K is configured to guide the developer cartridge 6K during attachment of the developer cartridge 6K to the drawer 100. More specifically, the second guide portion 103K is configured to, during attachment of the developer cartridge 6K to the drawer 100, guide the developer cartridge 6K subsequent to the first guide portion 102K. That is, during attachment of the developer cartridge 6K to the drawer 100, the protrusion 32A of the developer cartridge 6K is engaged with the second guide portion 103K. The second guide portion 103K is closer to the second portion 44B of the protrusion guide 44K than the first guide portion 102K. The second guide portion 103K extends from the first guide portion 102K. More specifically, for example, the second guide portion 103K extends from a lower end of the first guide portion 102K toward the second portion 44B of the protrusion guide 44K. The second guide portion 103K may be a cut that penetrates the side frame 41A in the width direction. Nevertheless, in other embodiments, for example, the second guide portion 103K may be a groove.

Figure 11:
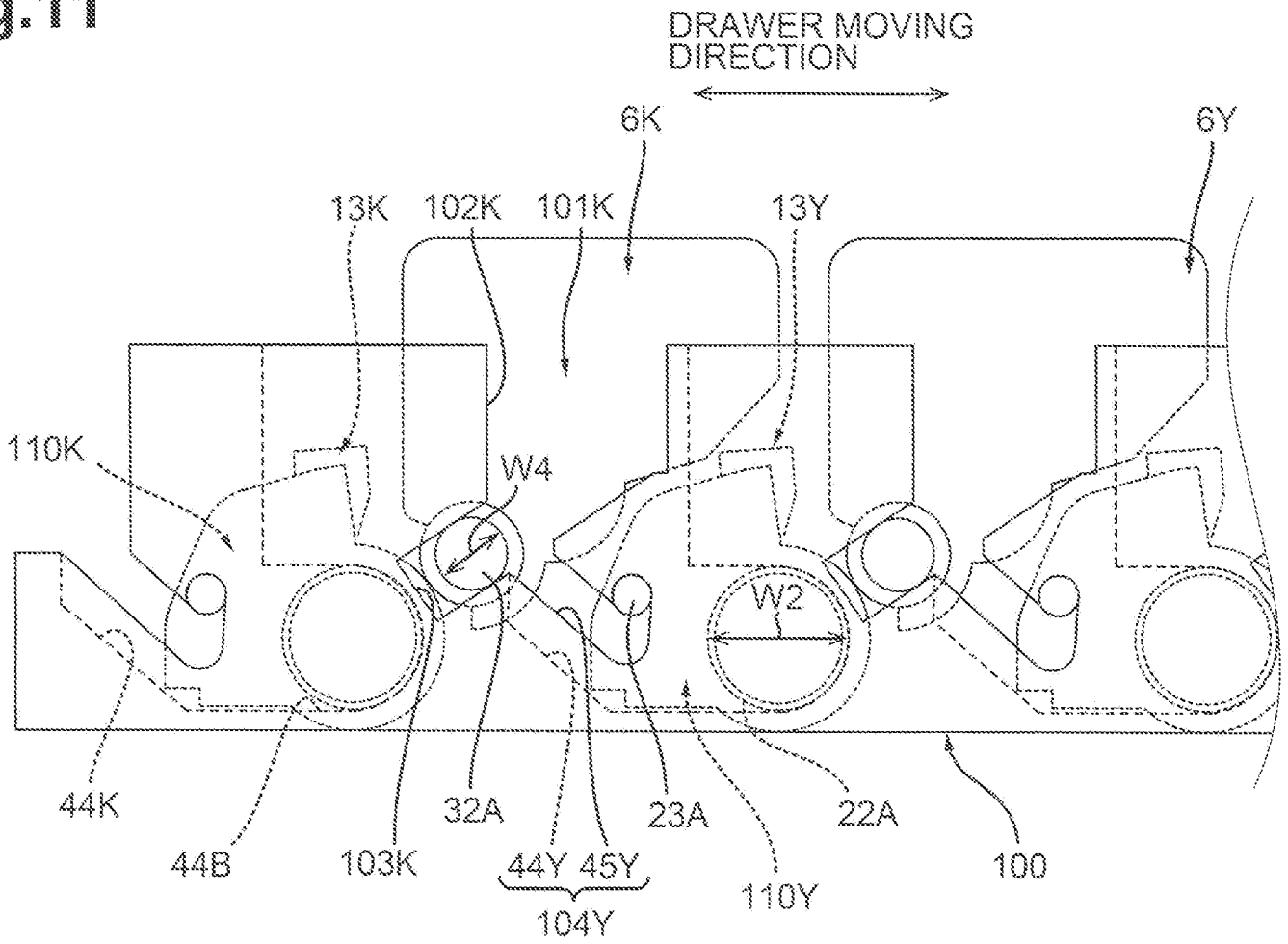
FIG. 11 is an explanatory diagram for explaining how to attach drum cartridges and developer cartridges to the drawer of FIG. 10 in the second illustrative embodiment according to one or more aspects of the disclosure.

The second guide portion 103K has a width W1 (refer to FIG. 10), which is narrower than a width (e.g., an outside diameter) W2 of the protrusion 22A (refer to FIG. 11). In other words, the width W2 of the protrusion 22A is greater than the width W1 of the second guide portion 103K. Therefore, this configuration may prevent or reduce entrance of the protrusion 22A of the drum cartridge 110Y into the second guide portion 103K during attachment of the drum cartridge 110Y to the drawer 100.

5.1.3 Third Guide Portion

As illustrated in FIG. 11, the third guide portion 104Y is configured to guide the drum cartridge 110Y during attachment of the drum cartridge 110Y to the drawer 100. The third guide portion 104Y is configured to, during attachment of the drum cartridge 110Y to the drawer 100, guide the drum cartridge 110Y subsequent to the first guide portion 102K. The third guide portion 104Y extends from the first guide portion 102K toward a direction opposite to the direction in which the second guide portion 103K extends, with respect to the drawer moving direction. The third guide portion 104Y includes a protrusion guide 44Y and a protrusion guide 45Y, similar to the drum cartridge guide 42Y (refer to FIG. 5) of the first illustrative embodiment. During attachment of the drum cartridge 110Y to the drawer 100, the protrusion 22A of the drum cartridge 110Y is engaged with the protrusion guide 44Y of the third guide portion 104Y. During attachment of the drum cartridge 110Y to the drawer 100, the protrusion 23A of the drum cartridge 110Y is engaged with the protrusion guide 45Y of the third guide portion 104Y.

Figure 13A:
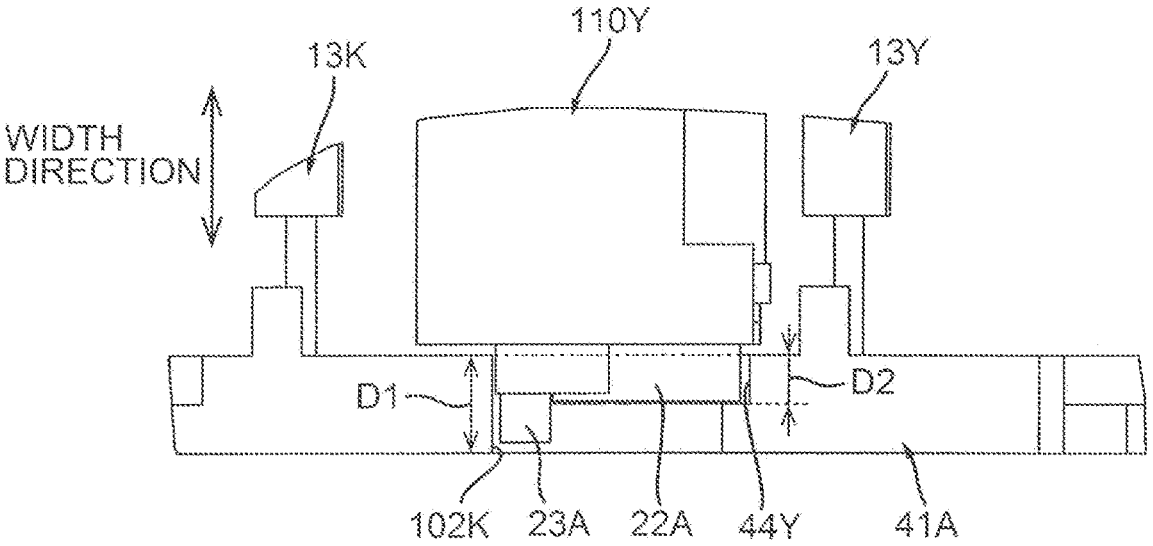
FIG. 13A illustrates one of side frames of the drawer having a first guide and one protrusion guide for explaining the depths of the first guide and the one protrusion guide.

As illustrated in FIG. 13A, the first guide portion 102K has a depth D1 in the width direction. The second guide portion 103K (refer to FIG. 10) and the protrusion guide 45Y (refer to FIG. 10) each have the same depth in the width direction as the depth D1 of the first guide portion 102K. The protrusion guide 44Y has a depth D2 in the width direction, which is shallower than the depth D1. This configuration may therefore prevent or reduce entrance of the protrusion 32A (refer to FIG. 11) of the developer cartridge 6K into the protrusion guide 44Y.

As illustrated in FIG. 10, the protrusion guide 45Y has a width W3, which is narrower than a width (e.g., an outside diameter) W4 of the protrusion 32A (refer to FIG. 11). In other words, the width W4 of the protrusion 32A is greater than the width W3 of the protrusion guide 45Y. This configuration may therefore prevent or reduce entrance of the protrusion 32A of the developer cartridge 6K into the protrusion guide 45Y.

As illustrated in FIG. 10, the drawer 100 further includes a developer cartridge guide 101Y, which is substituted for the developer cartridge guide 43Y and the drum cartridge guide 42M of the first illustrative embodiment, and a developer cartridge guide 101M, which is substituted for the developer cartridge guide 43M and the drum cartridge guide 42C of the first illustrative embodiment. All of the developer cartridge guides 101Y and 101M have the same or similar configuration as the developer cartridge guide 101K. Therefore, a detailed explanation for the developer cartridge guides 101Y and 101M will be omitted.

5.2 Drum Cartridges

Figure 12:
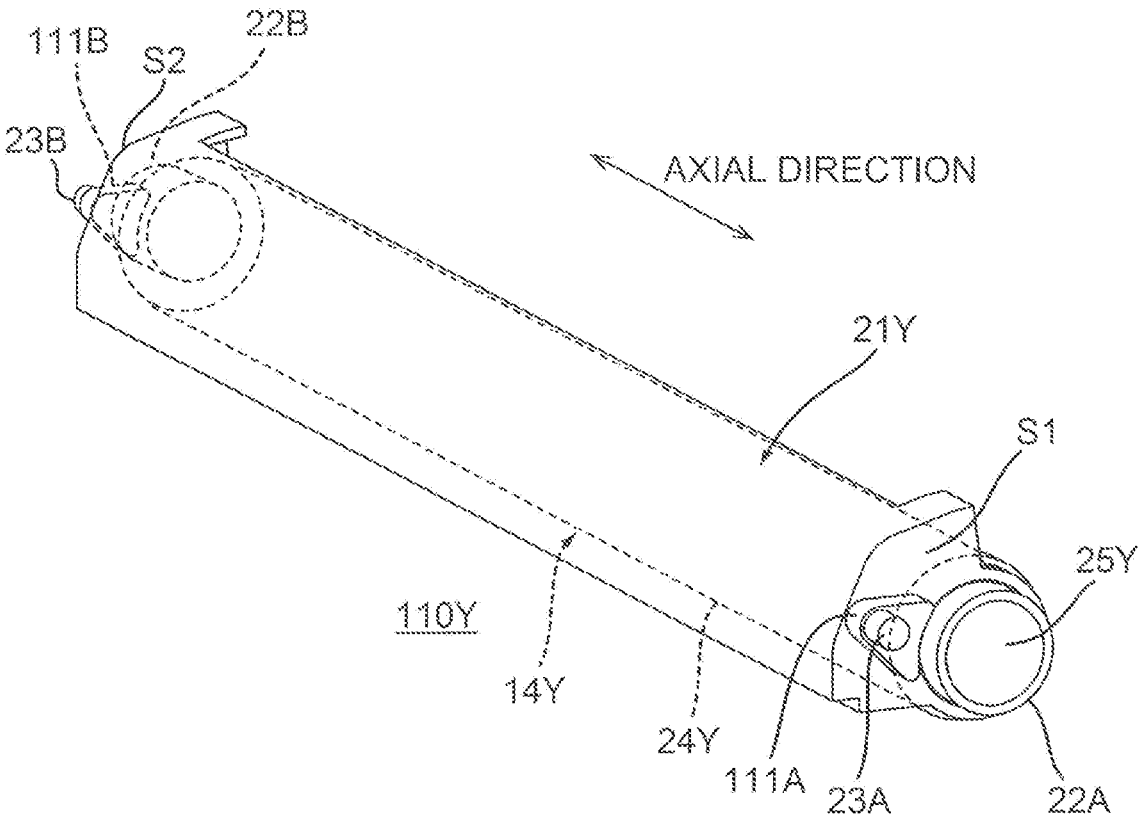
FIG. 12 is a perspective view of the drum cartridge in the second illustrative embodiment according to one or more aspects of the disclosure.

As illustrated in FIG. 12, the drum cartridge 110Y further includes a protrusion 22A and a protrusion 23A, similar to the drum cartridge 5K (refer to FIG. 3A) of the first illustrative embodiment. The drum cartridge 110Y further includes a base 111A, which is not included in the drum cartridge 5 of the first illustrative embodiment.

The base 111A supports the protrusion 23A. More specifically, the base 111A is disposed between the exterior surface S1 of the frame 21Y of the drum cartridge 110Y and the protrusion 23A in the axial direction. The base 111A protrudes outwardly from the exterior surface S1 in the axial direction. The base 111A extends along the exterior surface S1 in a direction intersecting the axial direction. The protrusion 23A extends from the base 111A.

Figure 13B:
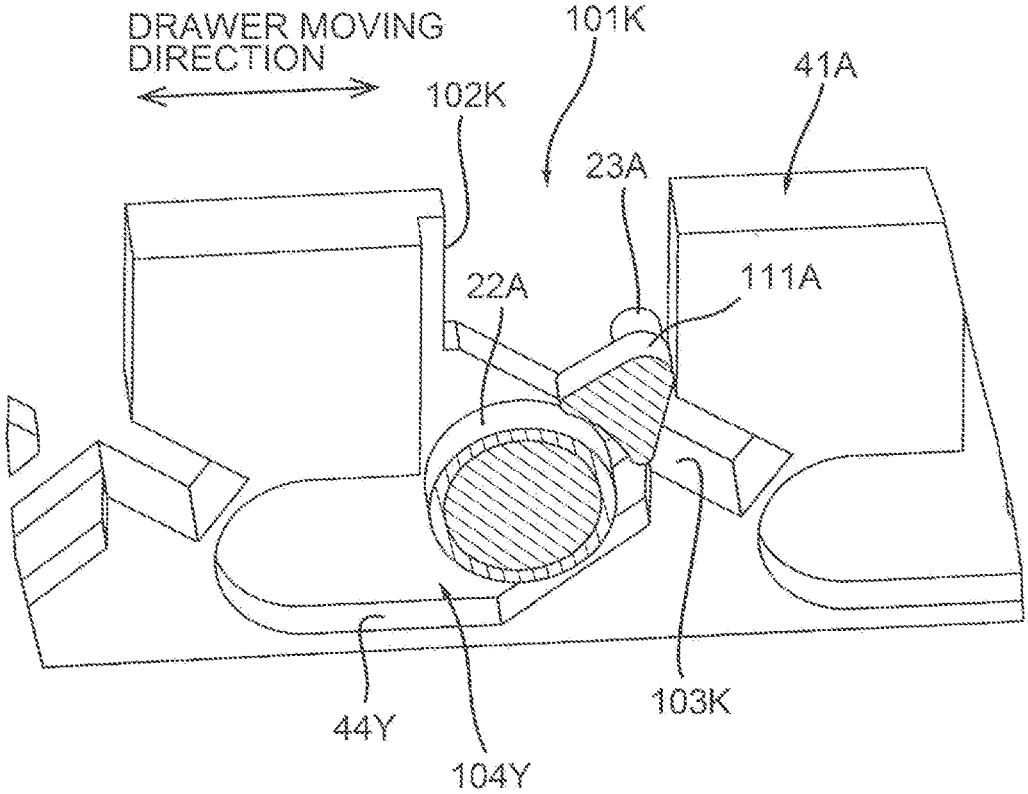
FIG. 13B illustrates a state during attachment of one of the dram cartridges to the drawer in the second illustrative embodiment according to one or more aspects of the disclosure, wherein a base and the other protrusion of the drum cartridge cannot be engaged with a second guide of the drawer.

The base 111A has a width that is greater than the protrusion 23A in the direction intersecting the axial direction. That is, the base 111A has a width greater than the width W1 of the second guide portion 103K (refer to FIG. 10). Therefore, as illustrated in FIG. 13B, the base 111A is not allowed to enter the second guide portion 103K. Consequently, the protrusion 23A extending from the base 111A is also not allowed to enter the second guide portion 103K.

5.4 Effects Achieved by Second Illustrative Embodiment

According to the second illustrative embodiment, as compared with a case where the developer cartridge guide 43K and the drum cartridge guide 42Y are separately provided in the drawer 4, the size of the drawer 100 may be reduced in the drawer moving direction.

According to the second illustrative embodiment, the same effects as the effects achieved by the first illustrative embodiment may also be obtained.

6. Third Illustrative Embodiment

Referring to FIGS. 14 to 17B, a third illustrative embodiment will be described in detail. An explanation will be given mainly for the parts different from the first illustrative embodiment, and an explanation will be omitted for the common components by assigning the same reference numerals thereto.

6.1 Exposure Heads

Figure 14:
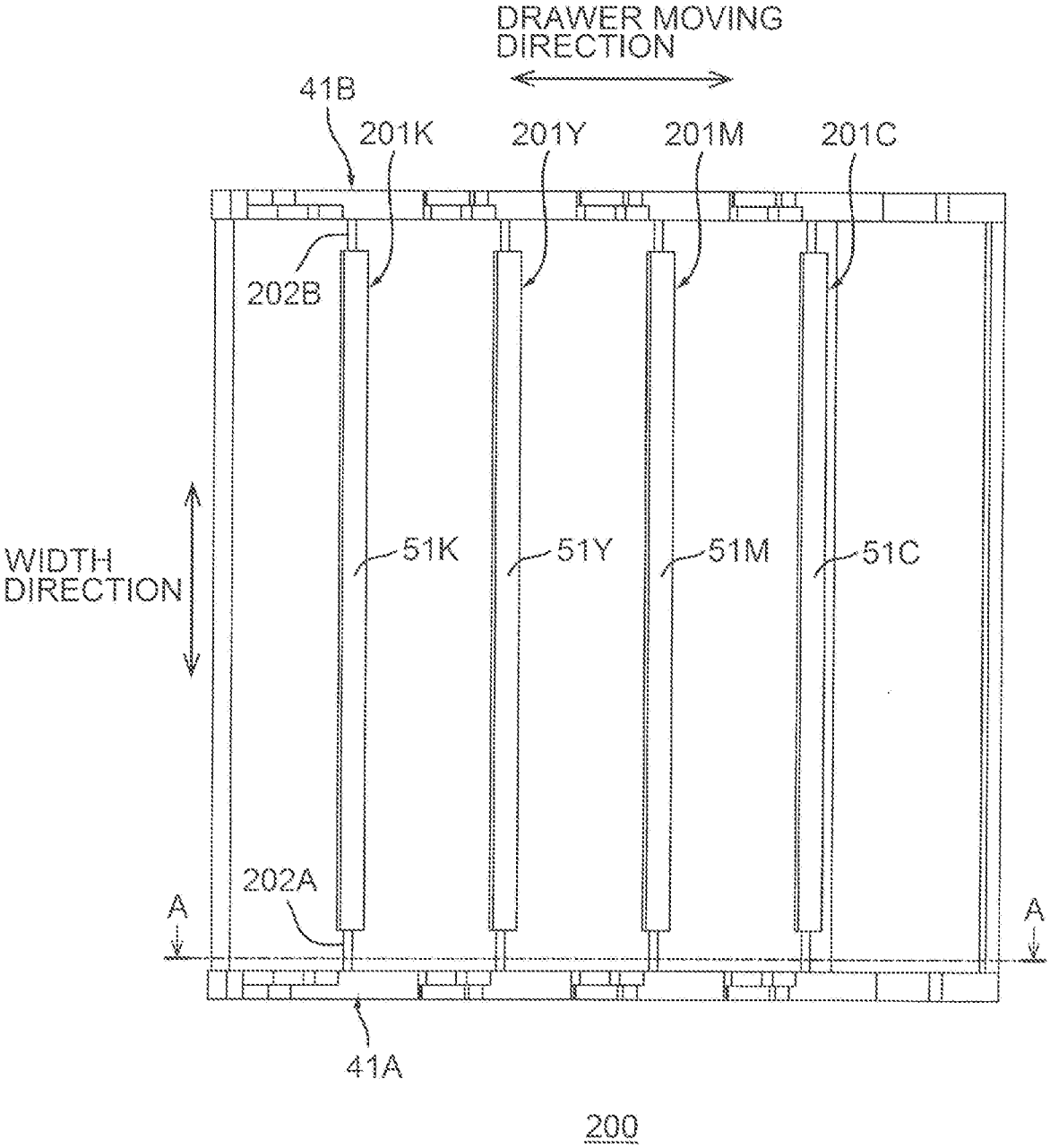
FIG. 14 is a top plan view of a drawer in a third illustrative embodiment according to one or more aspects of the disclosure.

An exposure head 201K of a drawer 200 is movable relative to the drawer 200 to which a drum cartridge 210K is not attached. As illustrated in FIG. 14, the exposure head 201K includes a frame 51K, a projection 202A, and a projection 202B.

The frame 51K extends in the width direction of the drawer 200. The frame 51K is disposed between the side frame 41A and the side frame 41B in the width direction of the drawer 200. The frame 51K is spaced apart from the side frame 41A in the width direction of the drawer 200. The frame 51K is also spaced apart from the side frame 41B in the width direction of the drawer 200.

The projection 202A is disposed between one end of the frame 51K of the exposure head 201K and the side frame 41A in the width direction of the drawer 200. The projection 202A extends from the one end of the frame 51K. The projection 202A extends in the width direction of the drawer 200. The projection 202A has a solid cylindrical shape. The projection 202A is engaged with an elongated hole (refer to FIG. 15) of the side frame 41A. The elongated hole 205 extends in the top-bottom direction.

The projection 202B is disposed between the other end of the frame 51K of the exposure head 201K and the side frame 41B in the width direction of the drawer 200. The projection 202B has the same shape (e.g., a solid cylindrical shape) and configuration as the projection 202A. The projection 202B is engaged with an elongated hole of the side frame 41B (not illustrated). The elongated hole of the side frame 41B has the same shape as the elongated hole 205 of the side frame 41A.

The exposure head 201K is supported by the drawer 200. More specifically, for example, the projection 202A of the frame 51K of the exposure head 201K is engaged with the elongated hole 205 of the side frame 41A, and the projection 202B of the frame 51K of the exposure head 201K is engaged with the elongated hole of the side frame 41B. The projection 202A of the frame 51K is movable along an edge of the elongated hole 205 of the side frame 41A. The projection 202B of the frame 51K is movable along an edge of the elongated hole of the side frame 41B. This configuration may therefore enable the exposure head 201K to move in the top-bottom direction relative to the drawer 200. The movable exposure head 201K may enable the position adjustment of the exposure head 201K relative to the photosensitive drum 14K during attachment of the drum cartridge 210K (refer to FIG. 17A) to the drawer 200.

The drawer 200 further includes exposure heads 201Y, 201M, and 201C, all of which have the same or similar configuration as the exposure head 201K. Therefore, a detailed explanation for the exposure heads 201Y, 201M, and 201C will be omitted.

6.2 Pressing Members and Springs

Figure 15:
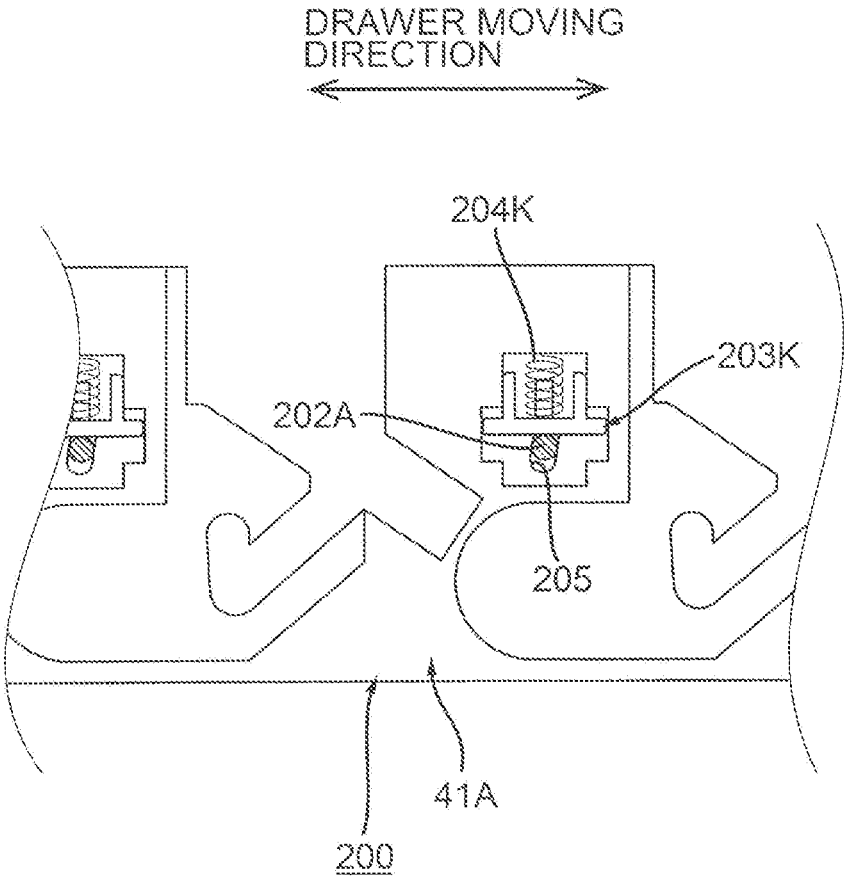
FIG. 15 is a cross sectional view taken along line A-A in FIG. 14 in the third illustrative embodiment according to one or more aspects of the disclosure.

As illustrated in FIG. 15, the drawer 200 further includes pressing members 203K and springs 204K.

In a state where the drum cartridge 210K is in the drum cartridge operating position and therefore fully attached to the drawer 200, the pressing member 203K applies a biasing force by pressing the exposure head 201K such that the projection 202A of the exposure head 201K contacts a contactable surface S41 (refer to FIG. 17B) of the drum cartridge 210K. More specifically, for example, the pressing member 203K is pressed downward by the spring 204K to press the projection 202A of the exposure head 201K downward. The pressing member 203K is disposed above the projection 202A and contacts the projection 202A. The pressing member 203K has a plate shape and extends in the drawer moving direction. The pressing member 203K is disposed at the side frame 41A. The pressing member 203K is movable in the top-bottom direction relative to the side frame 41A.

The spring 204K presses the pressing member 203K toward the projection 202A. The spring 204K is disposed at the side frame 41A. The spring 204K is located across the pressing member 203K from the projection 202A. The spring 204K contacts the pressing member 203K.

The drawer 200 further includes pressing members and springs for pressing the exposure heads 201Y, 201M, and 201C. All of the pressing members and the springs for pressing the exposure heads 201Y, 201M, and 201C have the same or similar configuration as the pressing member 203K and the spring 204K for pressing the exposure head 201K. Therefore, a detailed explanation for the pressing members and the springs for pressing the exposure heads 201Y, 201M, and 201C will be omitted.

6.3 Drum Cartridges

Figure 16:
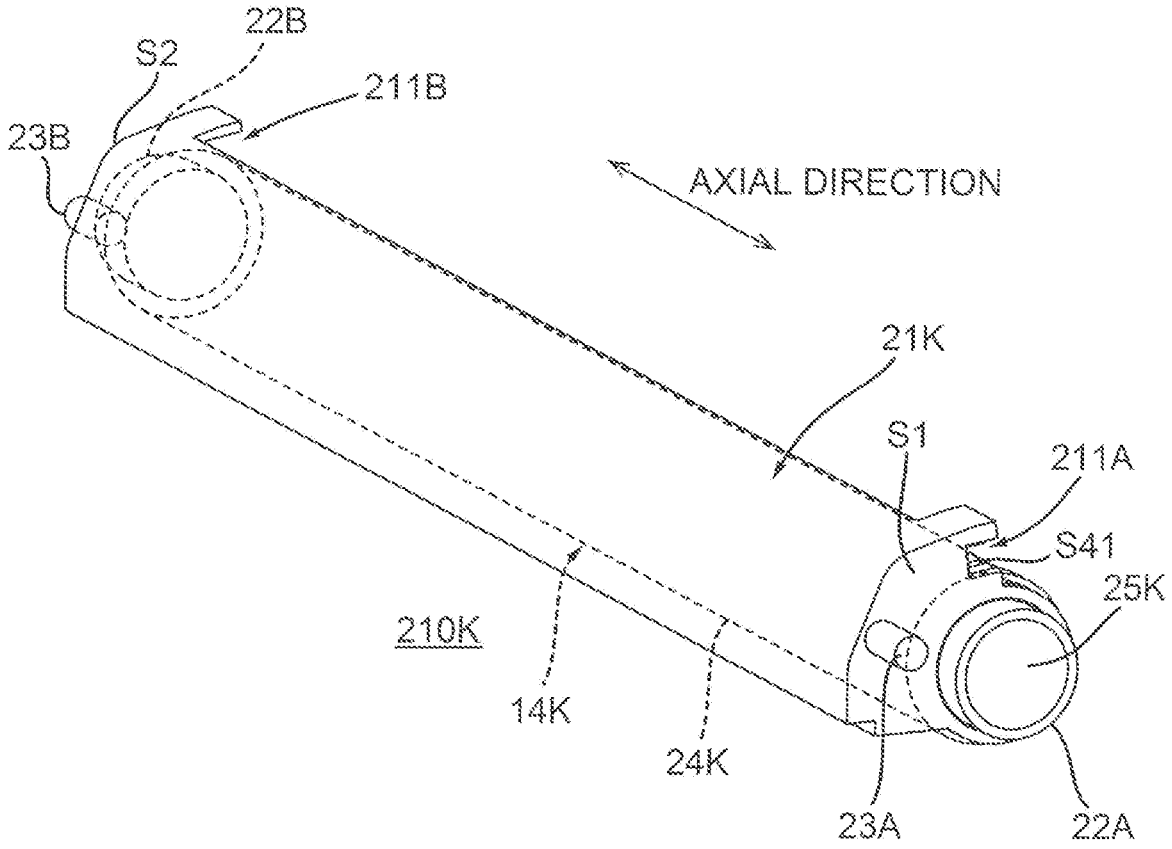
FIG. 16 is a perspective view of one of drum cartridges in the third illustrative embodiment according to one or more aspects of the disclosure.

As illustrated in FIG. 16, the drum cartridge 210K has a cut portion 211A and a cut portion 211B.

The cut portion 211A is defined in the one end of the frame 21K of the drum cartridge 210K in the axial direction. In a state where the drum cartridge 210K is in a drum cartridge operating position and therefore fully attached to the drawer 200, the projection 202A (refer to FIG. 17B) of the exposure head 13K is engaged with the cut portion 211A of the drum cartridge 210K. The contactable surface S41 defines a portion of the cut portion 211A. That is, the drum cartridge guide 210K has the contactable surface S41.

Figure 17A:
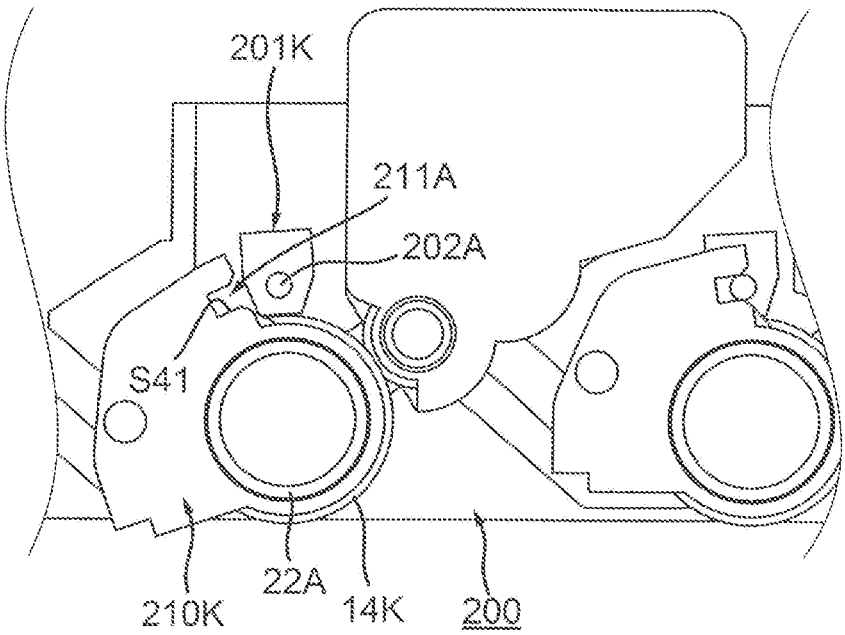
FIG. 17A is an explanatory diagram for explaining how to attach the drum cartridge of FIG. 16 to the drawer in the third illustrative embodiment according to one or more aspects of the disclosure, wherein a projection of a corresponding exposure head is not engaged with a cut portion of the drum cartridge.
Figure 17B:
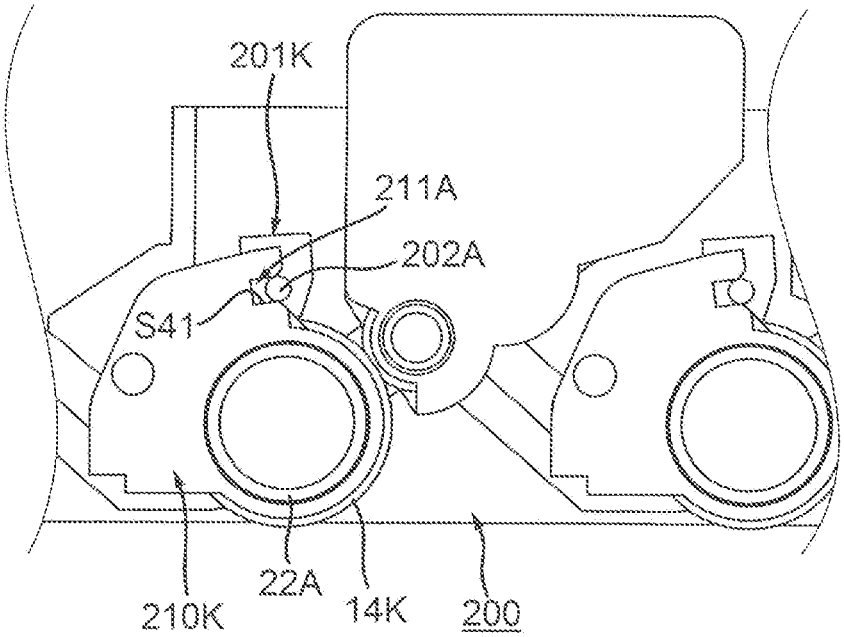
FIG. 17B is an explanatory diagram continued from FIG. 17A in the third illustrative embodiment according to one or more aspects of the disclosure, wherein the projection of the corresponding exposure head is engaged with the cut portion of the drum cartridge.

The contactable surface S41 may be one of the inner surfaces defining the cut portion 211A. As illustrated in FIGS. 17A and 17B, the contactable surface S41 contacts the projection 202A during attachment of the drum cartridge 210K to the drawer 200. More specifically, after the drum cartridge 210 is inserted to the drawer 200, the contactable surface S41 contacts the projection 202A when the projection 202A is engaged with the cut portion 211A by rotation of the drum cartridge 210K on the first projection 22A. Such a configuration may therefore enable fine adjustment of the position of the exposure head 201K relative to the photosensitive drum 14K. When the drum cartridge 210K is located at a first position (refer to FIG. 17B), the contactable surface S41 contacts the projection 202A. When the drum cartridge 210K is located at a second position (refer to FIG. 17A), the contactable surface S41 is spaced from the projection 202A. As illustrated in FIG. 17B, in a state where the projection 202A is engaged with the cut portion 211A, the contactable surface S41 is located below the projection 202A. In such a state, the drum cartridge 210K is in a drum cartridge operating position and fully attached to the drawer 200, and the projection 202A of the exposure head 13K is located between the pressing member 203K (refer to FIG. 15) and the contactable surface S41. Therefore, in the state where the drum cartridge 210K is fully attached to the drawer 200, the pressing member 203K presses the projection 202A toward the contact surface S41. Thus, the contactable surface S41 contacts the projection 202A, thereby positioning the exposure head 201K relative to the photosensitive drum 14K.

Positioning the exposure head 201K relative to the photosensitive drum 14K refers to retaining the exposure head 201K at the position by contact of the projection 202A and the contactable surface S41 such that the exposure head 201K is not allowed to move relative to the photosensitive drum 14K while the distance between the exposure head 201K and the photosensitive drum 14K is maintained at a predetermined distance constantly. That is, positioning the exposure head 201K relative to the photosensitive drum 14K does not include fixing of the exposure head 201K and the photosensitive drum 14K relative to each other using, for example, a screw or adhesive.

In a state where the drum cartridge 210K is fully attached to the drawer 200, the exposure head 201K is retained at the position so as not to move relative to the photosensitive drum 14K.

6.4 Effects Achieved by Third Illustrative Embodiment

According to the third illustrative embodiment, when the drum cartridge 210 is attached to the drawer 200, the position of the exposure head 201K may be adjusted finely relative to the photosensitive drum 14K and then the exposure head 201K may be retained at the position so as not to move relative to the photosensitive drum 14K.

According to the third illustrative embodiment, the same effects as the effects achieved by the first illustrative embodiment may also be obtained.

6.5 Variations of Third Illustrative Embodiment

In one example, the pressing member 203K may be disposed at the drum cartridge 210K.

In another example, the pressing member 203K may be, for example, a spring such as a torsion spring. In such a case, the drawer 200 does not include the spring 204K for pressing the pressing member 203K.

Figure 18:
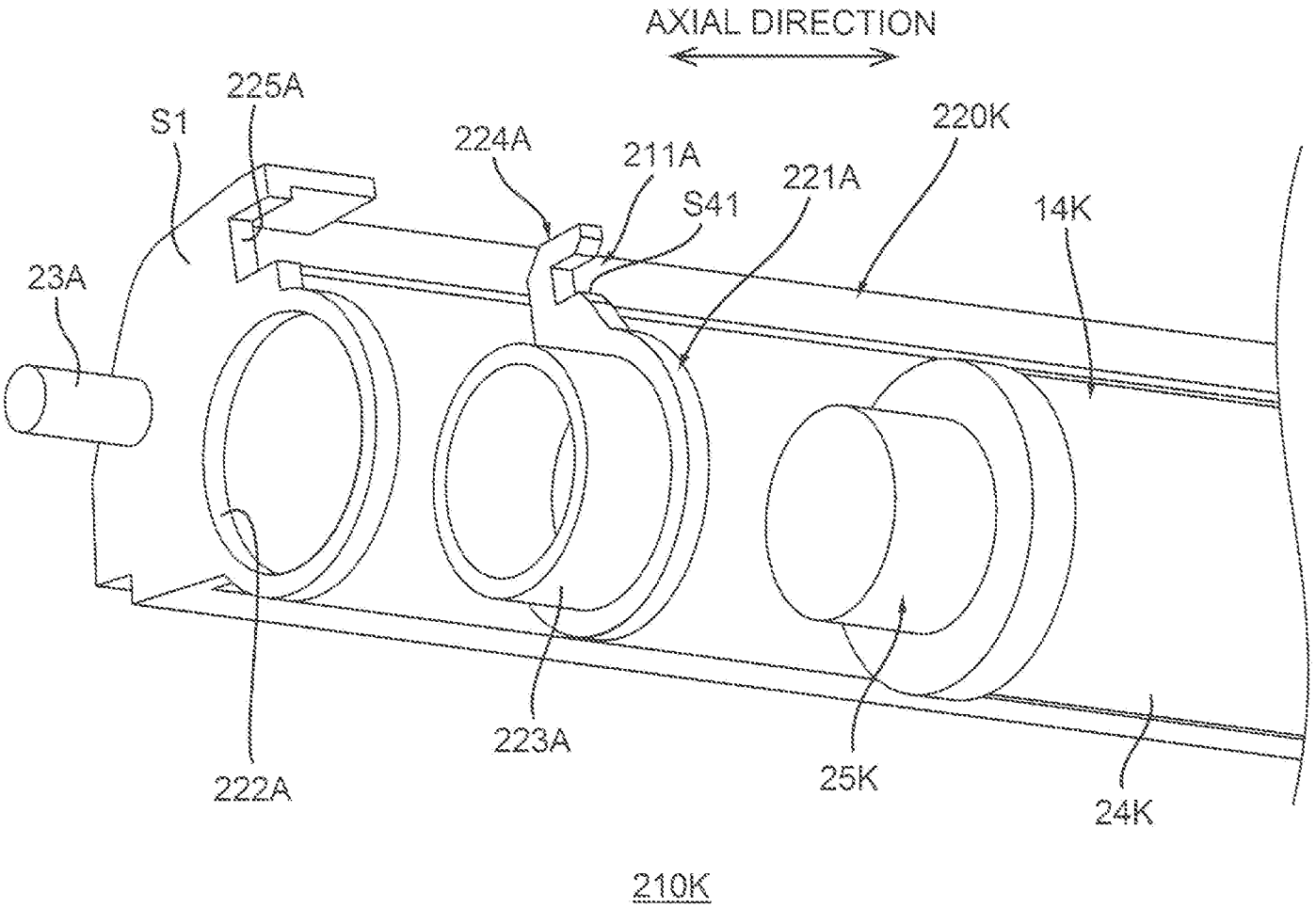
FIG. 18 is a partial perspective view of one of drum cartridges in a variation of the third illustrative embodiment according to one or more aspects of the disclosure.

In still another example, as illustrated in FIG. 18, the drum cartridge 210K may include a frame 220K and a flange receiving member 221A.

In such a case, the frame 220K has a through hole 222A substituted for the protrusion 22A (refer to FIG. 16). The flange receiving member 221A includes a cylindrical portion 223A, which is engageable with the through hole 222A. The drum frame 220K has a cut portion 225A. The flange receiving member 221A has a cut portion 211A. In a state where the flange receiving member 221A is attached to the frame 220K of the drum cartridge 210K, the cut portion 225A of the drum frame 220K overlaps the cut portion 211A of the flange receiving member 221A in the axial direction.

The flange receiving member 221A further includes a protrusion 224A.

The cylindrical portion 223A of the flange receiving member 221A extends in the axial direction. The cylindrical portion 223A is configured to be engaged with the flange 25K of the photosensitive drum 14K. That is, the flange receiving member 221A is configured to receive and support the flange 25K of the photosensitive drum 14K. The cylindrical portion 223A is configured to be engaged with the through hole 222A of the frame 220K of the drum cartridge 210K. This configuration may therefore enable the flange receiving member 221A to be attached to the frame 220K of the drum cartridge 210K. In a state where the flange receiving member 221A is attached to the frame 220K of the drum cartridge 210K, the cylindrical portion 223A protrudes outward relative to the exterior surface S1 of the frame 220K through the through hole 222A. The protruding portion of the cylindrical portion 223A may be engaged with the protrusion guide 44K (refer to FIG. 5) in like manner with the protrusion 22A (refer to FIG. 16).

The protrusion 224A extends from a circumferential surface of the cylindrical portion 223A in a diameter direction of the cylindrical portion 223A. The protrusion 224A has the cut portion 221A. The protrusion 224A has a contactable surface S41. That is, the flange receiving member 221A has the contactable surface S41 at a position different from the position where to receive the flange 25K of the photosensitive drum 14K. More specifically, for example, the flange receiving member 221A has the contactable surface S41 at the position other than the cylindrical portion 223A for receiving the flange 25K. In a state where the flange receiving member 221A is attached to the frame 220K of the drum cartridge 210K, the protrusion 224A of the drum frame 220K is located between the external surface S1 and the external surface S2 (refer to FIG. 16) in the axial direction. That is, in such a state, the contactable surface S41 is located between the external surface S1 and the external surface S2 in the axial direction. Further, in such a state, the protrusion 224A is located between the external surface S1 and the drum body 24K in the axial direction. That is, in such a state, the contactable surface S41 is located between the external surface S1 and the drum body 24K in the axial direction.

According to this variation, the flange receiving member 221A for receiving the flange 25K of the photosensitive drum 14K has the contactable surface S41. This configuration may therefore improve positioning accuracy of the exposure head 201K relative to the photosensitive drum 14K.

7. Fourth Illustrative Embodiment

Figure 19A:
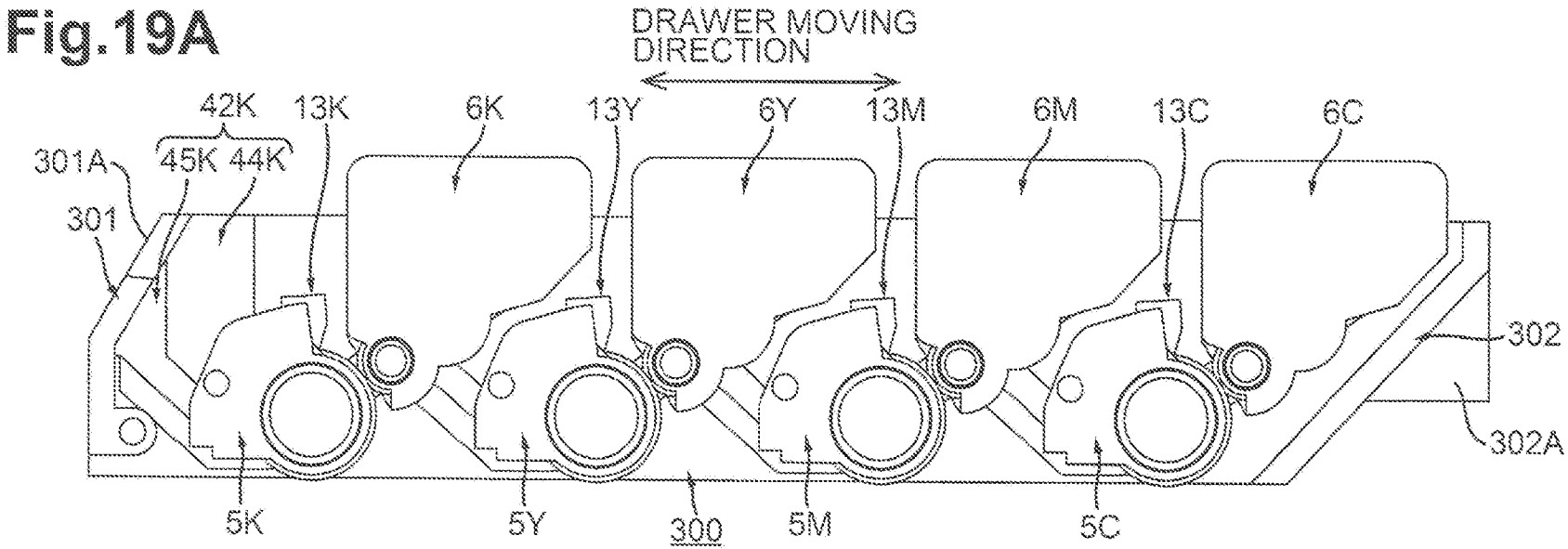
FIG. 19A is a side view of a drawer to which drum cartridges and developer cartridges are fully attached in a fourth illustrative embodiment according to one or more aspects of the disclosure, wherein one wall is located at a first position.
Figure 19B:
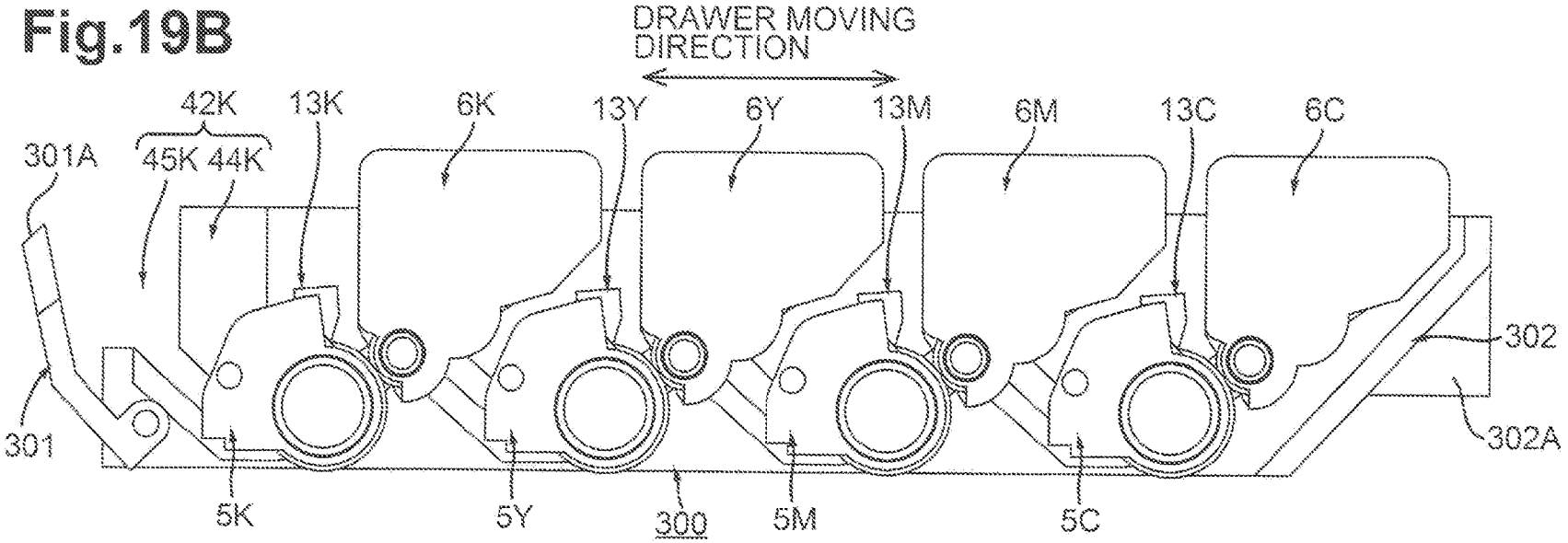
FIG. 19B is a side view of the drawer to which the drum cartridges and the developer cartridges are fully attached in the fourth illustrative embodiment according to one or more aspects of the disclosure, wherein the one wall is located at a second position.

Referring to FIGS. 19A and 19B, a fourth illustrative embodiment will be described in detail. An explanation will be given mainly for the parts different from the first illustrative embodiment, and an explanation will be omitted for the common components by assigning the same reference numerals thereto.

7.1 Drawer

A drawer 300 includes a wall 301 and a wall 302.

The wall 301 defines one end of the drawer 300 in the drawer moving direction. The wall 301 is located across the drum cartridge guide 42K from the exposure head 13K in the drawer moving direction. The wall 301 is movable in a direction away from the wall 302 in the drawer moving direction. More specifically, for example, the wall 301 is pivotable in the direction away from the wall 302. The wall 301 is movable between a first position (refer to FIG. 19A) and a second position (refer to FIG. 19B) in the drawer moving direction. The second position is farther from the wall 302 than the first position. That is, when the wall 301 is moved from the first position to the second position, the wall 301 moves in the direction away from the wall 302.

As illustrated in FIG. 19A, when the wall 301 is located at the first position, the wall 301 obstructs the moving route of the drum cartridge 5K defined along the drum cartridge guide 42K. Therefore, when the wall 301 is located at the first position while the drum cartridge 5K is fully attached to the drawer 300, the drum cartridge 5K is not allowed to be detached from the drawer 300.

As illustrated in FIG. 19B, when the wall 301 is located at the second position, the wall 301 does not obstruct the moving route of the drum cartridge 5K defined along the drum cartridge guide 42K. Therefore, when the wall 301 is located at the second position while the drum cartridge 5K is fully attached to the drawer 300, the drum cartridge 5K is allowed to be detached from the drawer 300.

In one example, an entire portion of the wall 301 may be movable. In another example, a partial portion of the wall 301 may be movable. The wall 301 may include a handle 301A of the drawer 300. The drawer 300 may include a spring that presses the wall 301 toward the wall 302. That is, the wall 301 may be pressed by the spring to be retained at the first position.

In such a case, the drawer 300 is movable from the inside position to the outside position in a direction from the wall 301 toward the wall 302. The wall 302 includes a handle 302A. The user may hold the handle 302A to move the drawer 300 from the inside position to the outside position. For attaching or detaching the drum cartridge 5K to or from the drawer 300, the user moves the wall 301 from the first position to the second position against the pressing force of the spring so as not to obstruct the moving route of the drum cartridge 5K defined along the drum cartridge guide 42K.

The wall 302 defines the other end of the drawer 300 in the drawer moving direction. The wall 302 is located across the exposure head 13K from the drum cartridge guide 42K in the drawer moving direction.

According to the fourth illustrative embodiment, the same effects as the effects achieved by the first illustrative embodiment may also be obtained.

7.2 Variations of Fourth Illustrative Embodiment

In one example, the drawer 300 may include a spring that may press the wall 301 in a direction away from the wall 302. In such a case, the wall 301 may be configured to, in response to movement of the cover 2B from the covering position (refer to FIG. 1) toward the uncovering position (refer to FIG. 2), move from the first position to the second position.

In such a case, the drawer 300 may be configured to move from the inside position to the outside position in the direction from the wall 302 toward the wall 301. The wall 301 may be configured to, in response to movement of the cover 2B from the covering position (refer to FIG. 1) toward the uncovering position (refer to FIG. 2), move from the first position to the second position by the pressing force of the spring. Generally, something moving may attract user's attention. Therefore, such a configuration may enable the user to become aware that the wall 301 is moving or has moved, and the user may understand that the drawer 300 needs to be moved from the inside position to the outside position by holding the handle 301A of the first wall 301. After the user moves the drawer 300 from the outside position to the inside position, the user may move the cover 2B from the uncovering position (refer to FIG. 2) to the covering position (refer to FIG. 1) to move the wall 301 from the second position to the first position. That is, the wall 301 may be pressed by the cover 2B to move from the second position to the first position against the pressing force of the spring.

8. Fifth Illustrative Embodiment

Referring to FIGS. 20A to 22B, a fifth illustrative embodiment will be described in detail. An explanation will be given mainly for the parts different from the first illustrative embodiment, and an explanation will be omitted for the common components by assigning the same reference numerals thereto.

8.1 Developer Cartridges

Figure 20A:
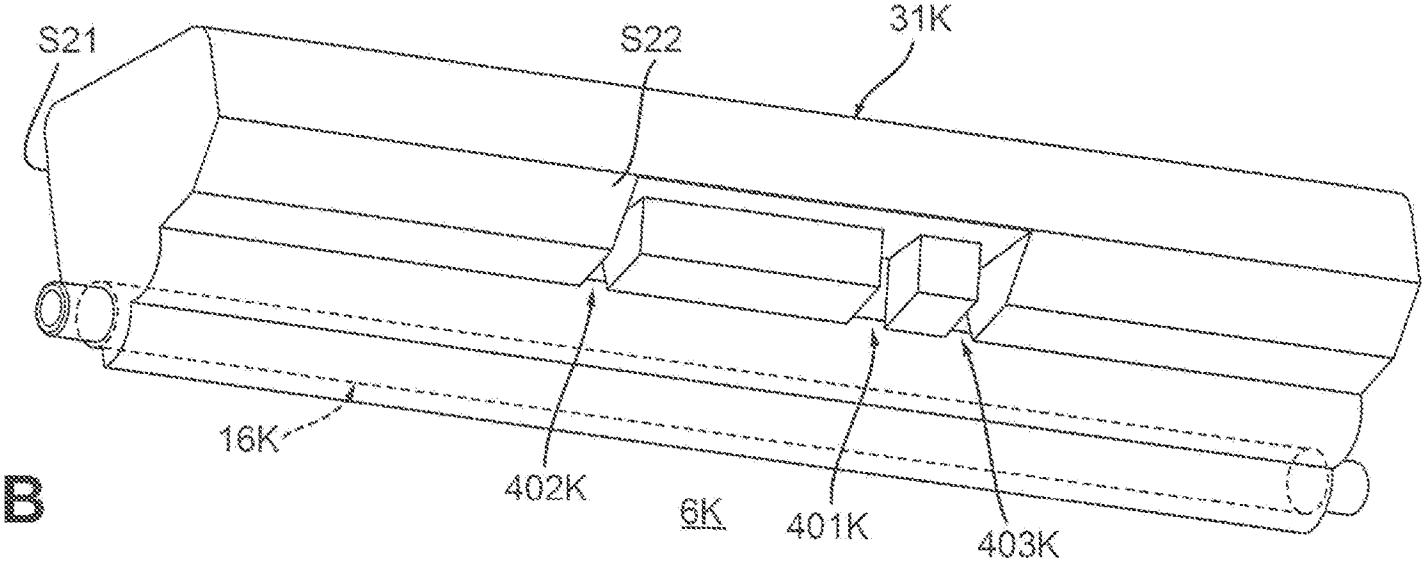
FIG. 20A is a perspective view of one of developer cartridges in a fifth illustrative embodiment according to one or more aspects of the disclosure.

As illustrated in FIG. 20A, a developer cartridge 6K has recessed portions 401K, 402K, and 403K.

When the developer cartridge 6K is placed at a proper position in the drawer 4, a protrusion 411Y (refer to FIG. 21) of a drum cartridge 5Y is engaged with the recessed portion 401K. Placing the developer cartridge 6K at a proper position in the drawer 4 refers to placing the developer cartridge 6K at a developer cartridge operating position where the developing roller 16K contacts the photosensitive drum 14K (refer to FIG. 1). More specifically, for example, in the state where the developer cartridge 6K is placed at the proper position in the drawer 4, the developer cartridge 6K is located between the drum cartridge 5K (refer to FIG. 21) and the drum cartridge 5Y (refer to FIG. 21) in the drawer moving direction (as compared to being placed at a different one of the developer cartridge operating positions in the drawer 4). The recessed portion 401K is defined in a housing 31K of the developer cartridge 6K. The housing 31K has exterior surfaces S21 and S22. In a state where the developer cartridge 6K is located between the drum cartridge 5K and the drum cartridge 5Y in the drawer moving direction, the exterior surface S22 is closer to the drum cartridge 5Y than the exterior surface S21 in the drawer moving direction. The recessed portion 401K is defined in the exterior surface S22. The recessed portion 401K is located between the recessed portion 402K and the recessed portion 403K in the direction in which the axis of the developing roller 16K extends. The recessed portion 401K is closer to the recessed portion 403K than the recessed portion 402K in the direction in which the axis of the developing roller 16K extends.

When the developer cartridge 6K is placed at the proper position in the drawer 4, a protrusion 412Y (refer to FIG. 21) of the drum cartridge 5Y is engaged with the recessed portion 402K. The recessed portion 402K is defined in the exterior surface S22.

When the developer cartridge 6K is placed at the proper position in the drawer 4, a protrusion 413Y (refer to FIG. 21) of the drum cartridge 5Y is engaged with the recessed portion 403K. The recessed portion 403K is defined in the exterior surface S22. The recessed portion 403K is spaced from the recessed portion 402K in the direction in which the axis of the developing roller 16K extends.

Figure 20B:
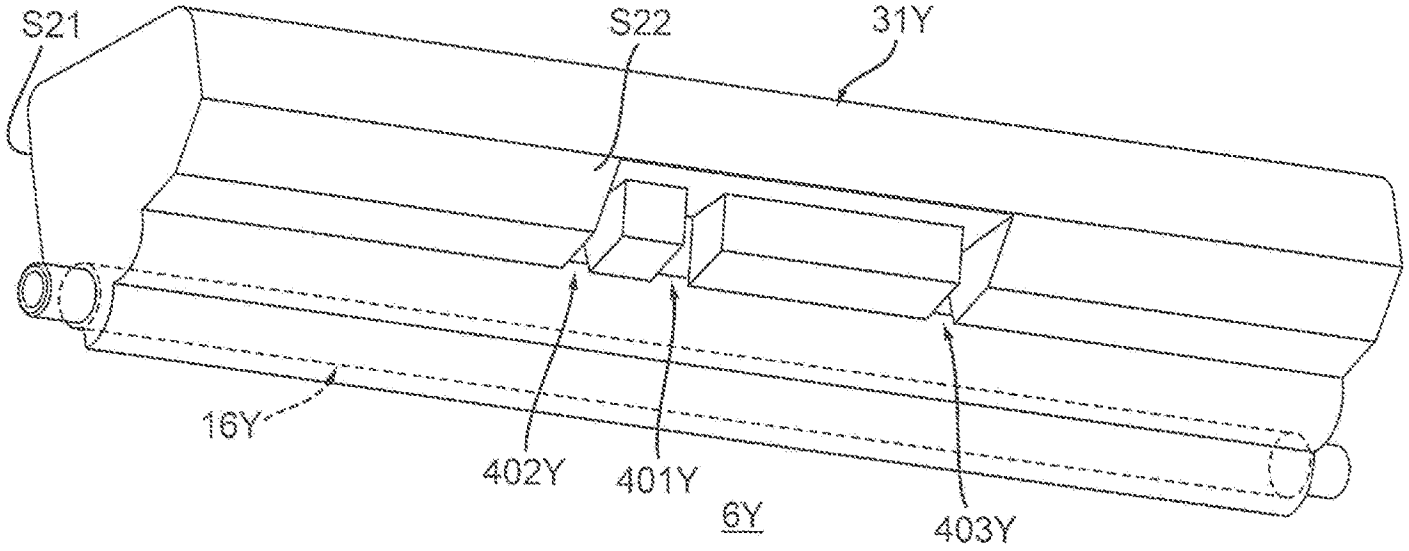
FIG. 20B is a perspective view of another of the developer cartridges in the fifth illustrative embodiment according to one or more aspects of the disclosure.

As illustrated in FIG. 20B, a developer cartridge 6Y may have recessed portions 401Y, 402Y, and 403Y.

When the developer cartridge 6Y is placed at a proper position in the drawer 4, a protrusion 411M (refer to FIG. 21) of a drum cartridge 5M is engaged with the recessed portion 401Y. In the state where the developer cartridge 6Y is placed at the proper position in the drawer 4, the developer cartridge 6Y is located between the drum cartridge 5Y (refer to FIG. 21) and the drum cartridge 5M (refer to FIG. 21) in the drawer moving direction. The recessed portion 401Y is defined in an exterior surface S22 of a housing 31Y of the drum cartridge 5Y. The recessed portion 401Y is located between the recessed portion 402Y and the recessed portion 403Y in the direction in which the axis of the developing roller 16K extends. The recessed portion 401Y is closer to the recessed portion 402Y than the recessed portion 403Y in the direction in which the axis of the developing roller 16Y extends. The recessed portion 401Y of the developer cartridge 6Y is located at a position different from the recessed portion 401K of the developer cartridge 6K (refer to FIG. 20A) in the width direction.

When the developer cartridge 6Y is placed at the proper position in the drawer 4, a protrusion 412M (refer to FIG. 21) of the drum cartridge 5M is engaged with the recessed portion 402Y. The recessed portion 402Y is defined in the exterior surface S22 of the housing 31Y of the drum cartridge 5Y. The recessed portion 402Y of developer cartridge 6Y is located at the same position as the recessed portion 402K (refer to FIG. 20A) of the developer cartridge 6K in the width direction.

When the developer cartridge 6Y is placed at the proper position in the drawer 4, a protrusion 413M (refer to FIG. 21) of the drum cartridge 5M is engaged with the recessed portion 403Y. The recessed portion 403Y is defined in the exterior surface S22 of the housing 31Y of the drum cartridge 5Y. The recessed portion 403Y is spaced from the recessed portion 402Y in the direction in which the axis of the developing roller 16Y extends. The recessed portion 403Y of the developer cartridge 6Y is located at the same position as the recessed portion 403K (refer to FIG. 20A) of the developer cartridge 6K in the width direction.

8.2 Drum Cartridges

Figure 21:
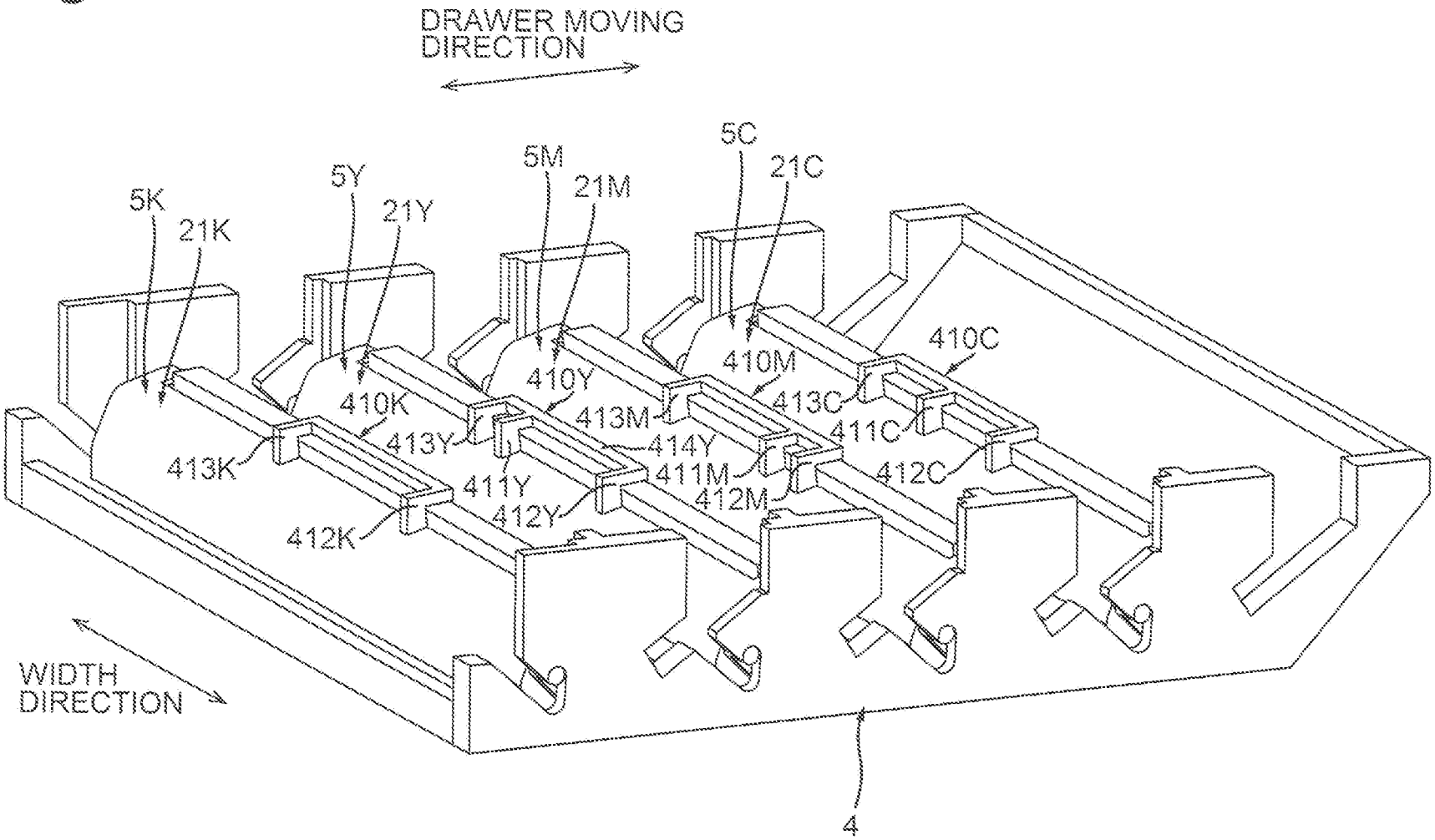
FIG. 21 is a perspective view of a drawer to which all drum cartridges are fully attached in the fifth illustrative embodiment according to one or more aspects of the disclosure.

As illustrated in FIG. 21, the drum cartridge 5Y further includes a handle 410Y.

The handle 410Y may be held by the user during attachment of the drum cartridge 5Y to the drawer 4. The handle 410Y is included in the drum frame 21Y. The handle 410Y includes the protrusions 411Y, 412Y, and 413Y, and a bar 414Y. That is, the drum cartridge 5Y includes the protrusion 411Y and the protrusion 411Y may be a portion of the handle 410Y.

The protrusion 411Y protrudes from the frame 21Y of the drum cartridge 5Y. The protrusion 411Y of the drum cartridge 5Y is located between the protrusion 412Y and the protrusion 413Y in the width direction. The protrusion 411Y is closer to the protrusion 413Y than the protrusion 412Y in the width direction. Therefore, in a state where the developer cartridge 6K is placed at a developer cartridge operating position between the drum cartridge 5K and the drum cartridge 5Y in the drawer moving direction, the protrusion 411Y is engaged with the recessed portion 401K of the developer cartridge 6K (refer to FIG. 22A). Nevertheless, if the developer cartridge 6Y is placed at the developer cartridge operating position between the drum cartridge 5K and the drum cartridge 5Y in the drawer moving direction, the protrusion 411Y cannot be engaged with the recessed portion 401Y of the developer cartridge 6Y (refer to FIG. 22B). That is, the protrusion 411Y may reduce or prevent the developer cartridge 6Y from being attached at the developer cartridge operating position between the drum cartridge 5K and the drum cartridge 5Y mistakenly in the drawer moving direction. In other words, the protrusion 411Y may reduce or prevent accidental misplacement of the developer cartridge 6Y in the drawer 4. Further, the protrusion 411Y may reduce or prevent the developer cartridge 6M or the developer cartridge 6C from being accidentally attached at the developer cartridge operating position between the drum cartridge 5K and the drum cartridge 5Y in the drawer moving direction.

As illustrated in FIG. 21, the protrusion 412Y protrudes from the frame 21Y of the drum cartridge 5Y.

The protrusion 413Y protrudes from the frame 21Y of the drum cartridge 5Y. The protrusion 413Y is spaced from the protrusion 412Y in the axial direction.

The bar 414Y extends in the axial direction. The bar 414Y connects between the protrusion 412Y and the protrusion 413Y. The protrusion 411Y is disposed between the protrusion 412Y and the protrusion 413Y in the axial direction.

Further, the protrusion 411M of the drum cartridge 5M may reduce or prevent the developer cartridge 6K, the developer cartridge 6M, or the developer cartridge 6C from being accidentally attached at the developer cartridge operating position between the drum cartridge 5Y and the drum cartridge 5M in the drawer moving direction. Further, the protrusion 411C of the drum cartridge 5C may reduce or prevent the developer cartridge 6K, the developer cartridge 6Y, or the developer cartridge 6C from being accidentally attached at the developer cartridge operating positon between the drum cartridge 5M and the drum cartridge 5C in the drawer moving direction.

8.3 Effects Achieved by Fifth Illustrative Embodiment

Figure 22A:
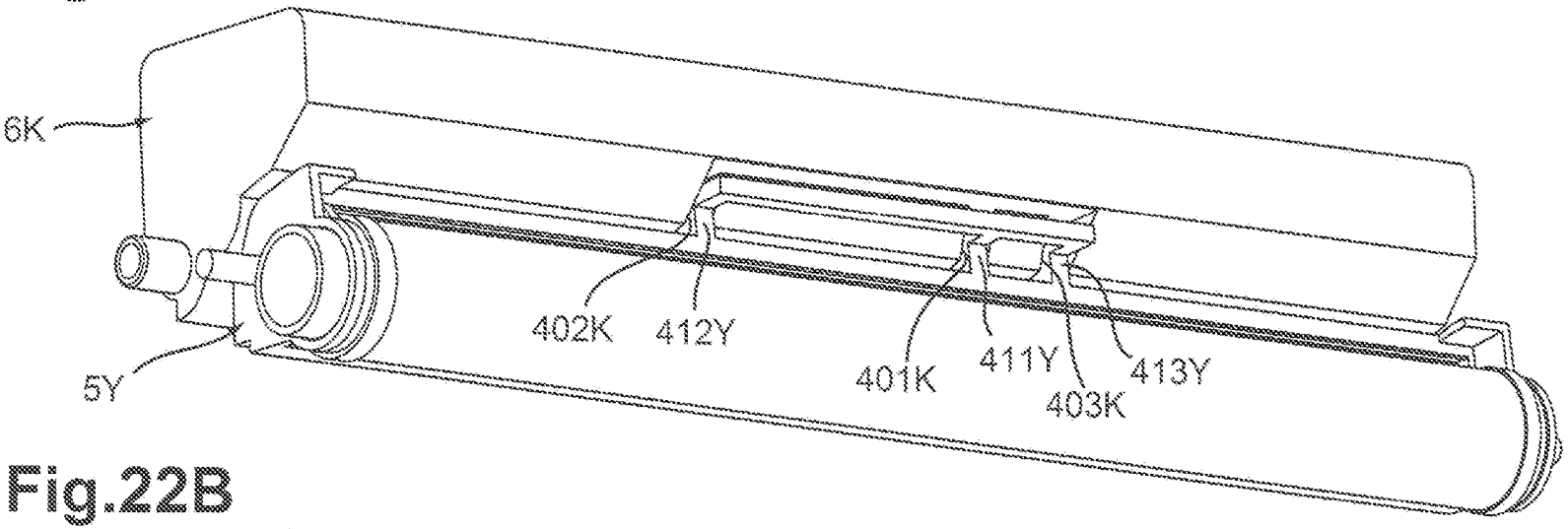
FIG. 22A illustrates a state where the developer cartridge of FIG. 20A is placed between one of the drum cartridges and another of the drum cartridges in the fifth illustrative embodiment according to one or more aspects of the disclosure, wherein a protrusion of the other of the drum cartridges is engaged with a recessed portion of the developer cartridge.
Figure 22B:
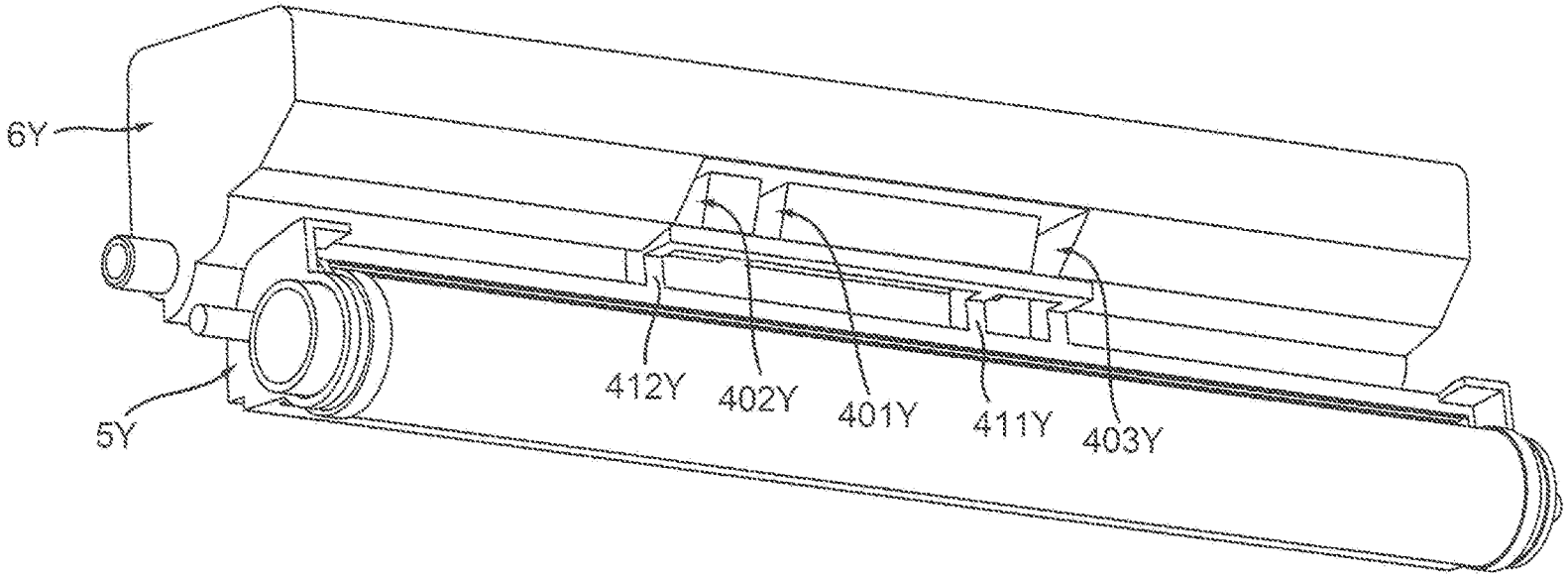
FIG. 22B illustrates a state where the developer cartridge of FIG. 20B is placed between the one of the drum cartridges and the another of the drum cartridges in the fifth illustrative embodiment according to one or more aspects of the disclosure, wherein a protrusion of the another of the drum cartridges is not able to be engaged with a recessed portion of the developer cartridge.

As illustrated in FIGS. 22A and 22B, the configuration according to the fifth illustrative embodiment may reduce or prevent accidental misplacement of the developer cartridge 6Y in the drawer 4.

According to the fifth illustrative embodiment, the same effects as the effects achieved by the first illustrative embodiment may also be obtained.

8.4 Variations of Fifth Illustrative Embodiment

Figure 23:
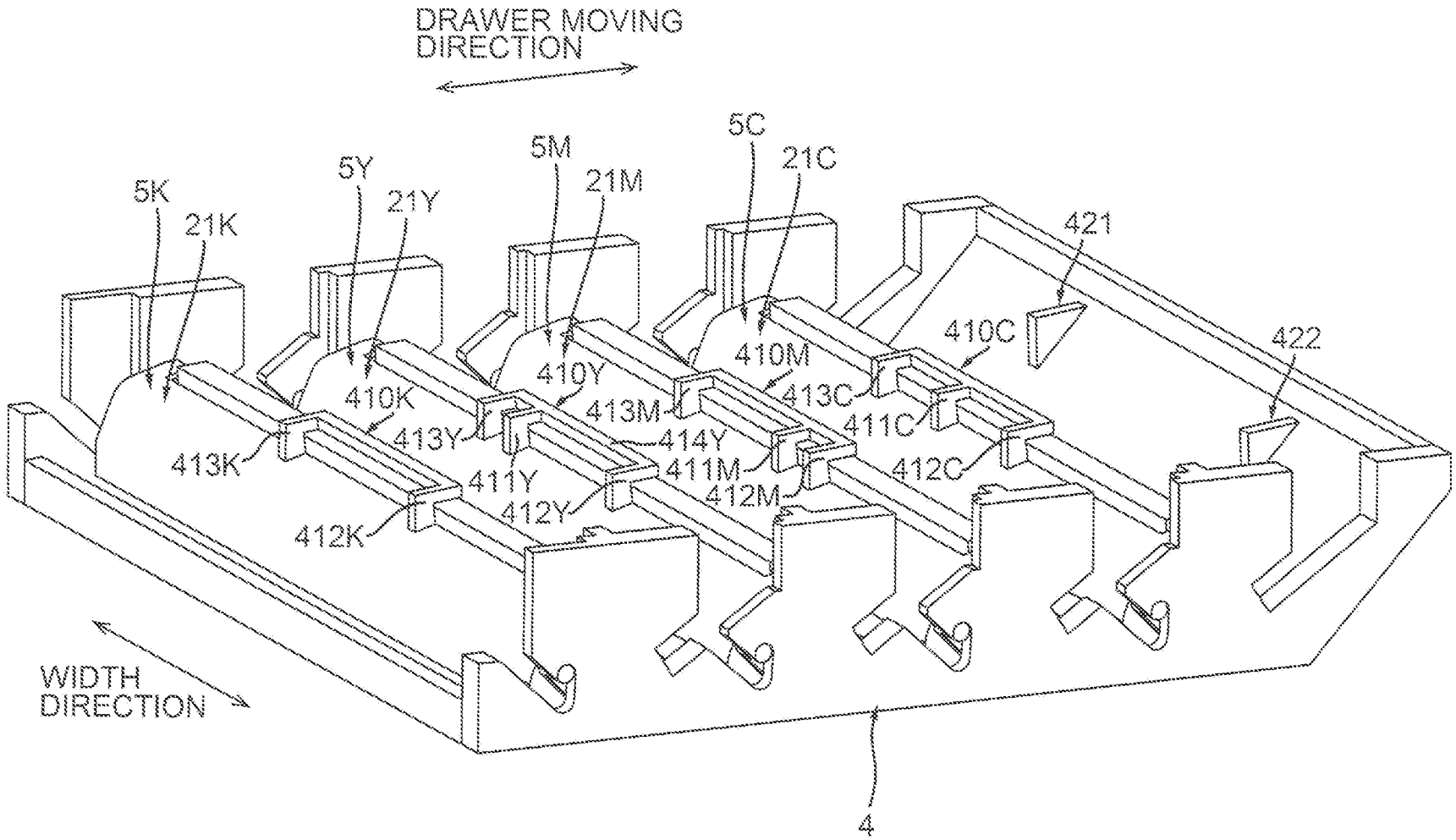
FIG. 23 is a perspective view of a drawer to which all of the drum cartridges are fully attached in a variation of fifth illustrative embodiment according to one or more aspects of the disclosure.

In one example, as illustrated in FIG. 23, the drawer 4 may further include protrusions 421 and 422.

Figure 24:
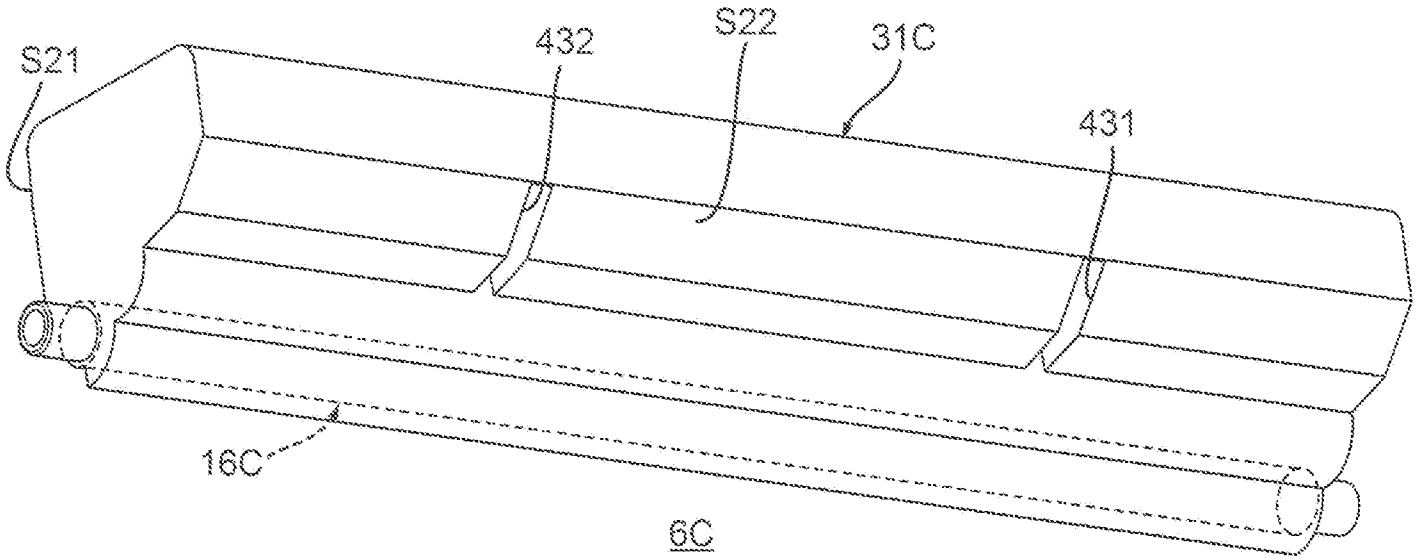
FIG. 24 is a perspective view of one of developer cartridges in the variation of the fifth illustrative embodiment according to one or more aspects of the disclosure.

As illustrated in FIG. 24, a developer cartridge 6C has a recessed portion 431 and a recessed portion 432. When the developer cartridge 6C is placed at a developer cartridge operating position next to the drum cartridge 5C and across the drum cartridge 5C from the drum cartridge 5K in the drawer moving direction, the protrusion 421 is engaged with the recessed portion 431 of the developer cartridge 6C. Nevertheless, if the developer cartridge 6K (refer to FIG. 20A) is placed at a developer cartridge operating position next to the drum cartridge 5C and across the drum cartridge 5C from the drum cartridge 5K in the drawer moving direction, the protrusion 421 cannot be engaged with any of the recessed portion 401K, the recessed portion 402K, and the recessed portion 403K of the developer cartridge 6K.

The protrusion 422 is spaced from the protrusion 421 in the width direction. When the developer cartridge 6C (refer to FIG. 24) is placed at a developer cartridge operating position next to the drum cartridge 5C and across the drum cartridge 5C from the drum cartridge 5K in the drawer moving direction, the protrusion 422 is engaged with the recessed portion 432 (refer to FIG. 24) of the developer cartridge 6C. Nevertheless, if the developer cartridge 6K (refer to FIG. 20A) is placed at a developer cartridge operating position next to the drum cartridge 5C and across the drum cartridge 5C from the drum cartridge 5K in the drawer moving direction, the protrusion 422 cannot be engaged with any of the recessed portion 401K, the recessed portion 402K, and the recessed portion 403K of the developer cartridge 6K.

That is, the protrusions 421 and 422 may reduce or prevent the developer cartridge 6K from being placed mistakenly at the developer cartridge operating position next to the drum cartridge 5C and across the drum cartridge 5C from the drum cartridge 5K in the drawer moving direction. Further, the protrusions 421 and 422 may reduce or prevent the developer cartridge 6Y or the developer cartridge 6M from being placed mistakenly at the developer cartridge operating position next to the drum cartridge 5C and across the drum cartridge 5C from the drum cartridge 5K in the drawer moving direction.

In one variation of the fifth illustrative embodiment, for example, a gap between the protrusion 412Y and the protrusion 413Y of the handle 410Y may be different from a gap between the protrusion 412M and the protrusion 413M of the handle 410M. More specifically, for example, the gap between the protrusion 412Y and the protrusion 413Y of the handle 410Y may be greater than the gap between the protrusion 412M and the protrusion 413M of the handle 410M.

In the fifth illustrative embodiment, the protrusion 411Y is disposed between the protrusion 412Y and the protrusion 413Y in the handle 410Y. Nevertheless, in another variation of the fifth illustrative embodiment, for example, the protrusion 412Y may be disposed between the protrusion 411Y and the protrusion 413Y or the protrusion 413Y may be disposed between the protrusion 411Y and the protrusion 412Y in the direction in which the axis of the developing roller 16K extends. In such a case, the protrusion 411Y may also protrude from the frame 21Y of the drum cartridge 5Y.

What is claimed is:

1. An image forming apparatus comprising:

a housing; and a drawer movable in a drawer moving direction between an inside position in which the drawer is positioned within the housing and an outside position in which the drawer is positioned outside the housing, the drawer comprising:

an exposure head mounted within the drawer;

a first guide that is positioned to receive a drum cartridge into a drum cartridge operating position in which a circumferential surface of a photosensitive drum included in the drum cartridge is positioned below the exposure head within the drawer; and a second guide that is positioned to receive a developer cartridge into a developer cartridge operating position in which a developing roller of the developer cartridge contacts the photosensitive drum;

wherein the first guide extends from a first side of the drawer into the drawer and toward the exposure head from a first side of the exposure head, and wherein the second guide extends from the first side of the drawer into the drawer and toward the exposure head from a second side of the exposure head opposite the first side of the exposure head.

2. The image forming apparatus of claim 1, wherein the first side comprises a top side of the drawer.

3. An image forming apparatus comprising:

a housing; and a drawer movable in a drawer moving direction between an inside position in which the drawer is positioned within the housing and an outside position in which the drawer is positioned outside the housing, the drawer comprising:

an exposure head mounted within the drawer;

a first guide that is positioned to receive a drum cartridge into a drum cartridge operating position in which a circumferential surface of a photosensitive drum included in the drum cartridge is adjacent to the exposure head; and a second guide that is positioned to receive a developer cartridge into a developer cartridge operating position in which a developing roller of the developer cartridge contacts the photosensitive drum;

wherein the first guide extends from a first side of the drawer into the drawer and toward the exposure head from a first side of the exposure head, and wherein the second guide extends from the first side of the drawer into the drawer and toward the exposure head from a second side of the exposure head opposite the first side of the exposure head, and wherein the exposure head is positioned above a photosensitive drum when a drum cartridge is inserted into the drum cartridge operating position.

4. The image forming apparatus of claim 1, wherein the first guide includes a force receiving surface facing the developer cartridge operating position, the force receiving surface positioned to receive a pressing force of a developer cartridge on a photosensitive drum when the developer cartridge and the drum cartridge are inserted into the developer cartridge operating position and the drum cartridge operating position, respectively.

5. The image forming apparatus of claim 1, wherein the drawer further includes:

a second exposure head mounted within the drawer and spaced apart from the exposure head in the drawer moving direction;

wherein the first guide extends from the first side of the drawer between the exposure head and the second exposure head.

6. The image forming apparatus of claim 5, wherein the drawer further includes:

a third guide extending from the first side of the drawer between the exposure head and the second exposure head, the third guide being positioned to receive a second developer cartridge into a second developer cartridge operating position in which a developing roller of the second developer cartridge contacts a photosensitive drum of a second drum cartridge that is adjacent to the second exposure head.

7. The image forming apparatus of claim 6, wherein the first guide includes:

a first guide portion extending into the drawer from the first side;

a second guide portion extending from the first guide portion toward a second developer cartridge operating position in which a developing roller of the second developer cartridge contacts a photosensitive drum of a second drum cartridge that is adjacent to the second exposure head;

a third guide portion extending from the first guide portion toward the drum cartridge operating position; the third guide portion having a first width;

wherein the second guide portion has a second width that is greater than the first width of the third guide portion.

8. The image forming apparatus of claim 1, further comprising:

a drum cartridge inserted into the drum cartridge operating position via the first guide; and a developer cartridge inserted into the developer cartridge operating position via the second guide.

9. The image forming apparatus of claim 8, wherein the first guide includes:

a first guide portion extending into the drawer from the first side;

a second guide portion extending from the first guide portion toward a second developer cartridge operating position in which a developing roller of the second developer cartridge contacts a photosensitive drum of a second drum cartridge that is adjacent to the second exposure head;

a third guide portion extending from the first guide portion toward the drum cartridge operating position, the third guide portion including a first protrusion guide and a second protrusion guide;

wherein the drum cartridge comprises a first protrusion and a second protrusion having a width greater than a width of the first protrusion guide, such that in the drum cartridge operating position, the first protrusion is engaged with the first protrusion guide of the third guide portion and the second protrusion is engaged with the second protrusion guide of the third guide portion;

wherein the developer cartridge comprises a second protrusion having a width that is greater than a width of the first protrusion guide of the third guide portion.

10. The image forming apparatus of claim 9, wherein the first guide portion has a first depth in a width direction orthogonal to the drawer moving direction;

wherein the first protrusion guide has a second depth in the width direction that is shallower than the first depth;

wherein the drawer comprises a frame including a cut penetrating the frame in the width direction that forms at least the first protrusion guide; and wherein the second protrusion guide comprises a groove.

11. The image forming apparatus of claim 9, wherein the drum cartridge comprises:

a photosensitive drum including a flange;

a flange receiving member having a cylindrical portion sized and positioned to receive the flange;

a frame having a through hole sized and positioned to receive the cylindrical portion;

wherein the flange receiving member further includes a contactable surface positioned to engage a projection of the exposure head when the drum cartridge is in the drum cartridge operating position, the contactable surface being positioned offset from the cylindrical portion in a radial direction.

12. The image forming apparatus of claim 8, further comprising a second developer cartridge inserted into a second developer cartridge operating position via the first guide, the second developer cartridge operating position being a position in which a developing roller of the second developer cartridge contacts a photosensitive drum of a second drum cartridge that is adjacent to a second exposure head;

wherein the drum cartridge includes a protrusion;

wherein the developer cartridge includes a first recessed portion and the second developer cartridge includes a second recessed portion;

wherein, when the drum cartridge is in the drum cartridge operating position and the second developer cartridge is in the second developer cartridge position, the protrusion fits within the second recessed portion of the second developer cartridge; and wherein, when the drum cartridge is in the drum cartridge operating position and the developer cartridge is being inserted at the first guide, the protrusion blocks the first recessed portion and thereby prevents the developer cartridge from being inserted into the second developer cartridge operating position.

13. The image forming apparatus of claim 12, wherein the drum cartridge includes a handle including the protrusion.

14. The image forming apparatus of claim 9, wherein the drum cartridge includes a base positioned to support the first protrusion, the base having a width greater than a width of the second guide portion.

15. The image forming apparatus of claim 8, wherein the drum cartridge includes a photosensitive drum having a diameter equal to or greater than 20 mm and less than 28 mm.

16. The image forming apparatus of claim 8, wherein in the drum cartridge operating position, the drum cartridge is positioned at least partially below the developer cartridge but is removable from the drawer without removing the developer cartridge.

17. The image forming apparatus of claim 1, wherein the exposure head is movable relative to the drawer when a drum cartridge is not inserted into the drum cartridge operating position but remains in a fixed position relative to the drawer when a drum cartridge is inserted into the drum cartridge operating position.

18. The image forming apparatus of claim 17, wherein the exposure head includes a projection that is engaged by a contactable surface of the drum cartridge when the drum cartridge is inserted into the drum cartridge operating position.

19. The image forming apparatus of claim 1, wherein the drawer includes a first wall and a second wall, the first wall being at a first end of the drawer in a drawer moving direction, the second wall being on an opposite end of the drawer from the first wall; and wherein at least a portion of the first wall is movable in a direction away from the second wall in a drawer moving direction.

20. The image forming apparatus of claim 19, wherein the first wall is pivotable between a first position and a second position, the second position being further from the second wall than the first position.

21. The image forming apparatus of claim 20, further comprising a spring that applies a biasing force to the first wall toward the first position.

22. The image forming apparatus of claim 1, wherein the drawer includes a drawer protrusion positioned to block a recessed portion of at least one developer cartridge when the at least one developer cartridge is being inserted into a developer cartridge operating position within the drawer.

23. An image forming apparatus comprising:

a housing;

a drawer movable in a drawer moving direction between an inside position in which the drawer is positioned within the housing and an outside position in which the drawer is positioned outside the housing, the drawer comprising an exposure head mounted within the drawer;

a drum cartridge inserted into a drum cartridge operating position in which a circumferential surface of a photosensitive drum included in the drum cartridge is adjacent to the exposure head; and a developer cartridge inserted into a developer cartridge operating position in which a developing roller of the developer cartridge contacts the photosensitive drum;

wherein in the drum cartridge operating position, the drum cartridge is positioned at least partially below the developer cartridge but is removable from the drawer without removing the developer cartridge.

24. The image forming apparatus of claim 23, wherein the drawer further comprises:

a first guide that is positioned to receive the drum cartridge into the drum cartridge operating position; and a second guide that is positioned to receive the developer cartridge into the developer cartridge operating position;

wherein the first guide extends from a first side of the drawer into the drawer and toward the exposure head from a first side of the exposure head, and wherein the second guide extends from the first side of the drawer into the drawer and toward the exposure head from a second side of the exposure head opposite the first side.

* * * * *